US010559894B2

(12) United States Patent
Kawamura et al.

(10) Patent No.: US 10,559,894 B2
(45) Date of Patent: Feb. 11, 2020

(54) METHOD OF MANUFACTURING CONNECTION STRUCTURE, WIRE HARNESS, AND DEVICE FOR MANUFACTURING CONNECTION STRUCTURE

(71) Applicants: FURUKAWA ELECTRIC CO., LTD., Tokyo (JP); FURUKAWA AUTOMOTIVE SYSTEMS, INC., Inukami-gun (JP)

(72) Inventors: Yukihiro Kawamura, Shiga (JP); Satoshi Takamura, Shiga (JP); Takeshi Hyotani, Shiga (JP); Koichi Kitagawa, Shiga (JP); Eiji Aramaki, Shiga (JP)

(73) Assignees: FURUKAWA ELECTRIC CO., LTD., Tokyo (JP); FURUKAWA AUTOMOTIVE SYSTEMS, INC., Inukami-gun (JP)

( * ) Notice: Subject to any disclaimer, the term of this patent is extended or adjusted under 35 U.S.C. 154(b) by 544 days.

(21) Appl. No.: 14/832,700

(22) Filed: Aug. 21, 2015

(65) Prior Publication Data

US 2015/0364834 A1 Dec. 17, 2015

Related U.S. Application Data

(63) Continuation of application No. PCT/JP2013/085226, filed on Dec. 27, 2013.

(30) Foreign Application Priority Data

Feb. 23, 2013 (JP) ..... 2013-033969

(51) Int. Cl.

| | |
|---|---|
| ***H01R 4/18*** | (2006.01) |
| ***H01R 43/05*** | (2006.01) |
| ***H01R 4/2495*** | (2018.01) |

(52) U.S. Cl.

CPC ..... *H01R 4/18* (2013.01); *H01R 4/2495* (2013.01); *H01R 43/05* (2013.01); *Y10T 29/4922* (2015.01); *Y10T 29/53235* (2015.01)

(58) Field of Classification Search

CPC ..... H01R 4/18; H01R 4/2495; H01R 4/20; H01R 4/62; H01R 43/05; H01R 43/052;

(Continued)

(56) References Cited

U.S. PATENT DOCUMENTS 3,955,044 A 5/1976 Hoffman et al.
4,055,889 A * 11/1977 Fusco ..... H01R 43/00 29/710

(Continued)

FOREIGN PATENT DOCUMENTS

CN 101194325 A 6/2008
CN 101607343 A 12/2009

(Continued)

OTHER PUBLICATIONS

International Search Report dated Apr. 1, 2014 for PCT/JP2013/085226 filed on Dec. 27, 2013 with English Translation.

(Continued)

*Primary Examiner* — Peter Dungba Vo
*Assistant Examiner* — Azm A Parvez
(74) *Attorney, Agent, or Firm* — Oblon, McClelland, Maier & Neustadt, L.L.P.

(57) ABSTRACT

To provide a method and a device for manufacturing a connection structure (1) and a wire harness (2). The connection structure connects an insulated wire (100) comprising a wire tip portion (103), an insulating covering (102) being stripped from the tip thereof, to a crimp terminal (200) comprising a closed-barrel-type crimping portion (230) allowing crimp connection with the wire tip portion (103) and has stable conductivity by crimping an aluminum core (Continued)

wire (101) by the crimping portion (230). The method comprises a carrier cutting step for separating crimp terminals (200) from a terminal connecting belt (300) comprising the crimp terminals (200) attached to a carrier (250) in a longitudinal direction, a wire insertion step for inserting wire tip portions (103) into the crimping portions (230) of the separated crimp terminals (200), and a crimping step for crimping the crimping portions (230) with the inserted wire tip portions (103).

16 Claims, 13 Drawing Sheets

(58) Field of Classification Search
CPC ..... H01R 43/055; Y10T 29/4922; Y10T 29/53235
USPC ..... 29/861, 857, 825, 592.1, 862, 863, 869, 29/874
See application file for complete search history.

(56) References Cited

U.S. PATENT DOCUMENTS

| | | | | |
|---|---|---|---|---|
| 4,114,253 | A * | 9/1978 | Loomis | H01R 3/04 29/566.2 |
| 4,781,619 | A * | 11/1988 | Ikeda | H01R 13/465 29/748 |
| 5,706,570 | A * | 1/1998 | Inoue | H01R 3/048 29/566.2 |
| 7,024,752 | B2 * | 4/2006 | Imgrut | H01R 3/0486 29/448 |
| 2006/0225909 | A1 | 10/2006 | Kurimoto et al. | |
| 2013/0095708 | A1 * | 4/2013 | Mitose | H01R 4/184 439/878 |

FOREIGN PATENT DOCUMENTS

| | | | |
|---|---|---|---|
| JP | 3-245413 | A | 11/1991 |
| JP | 7-14659 | A | 1/1995 |
| JP | 8-37079 | A | 2/1996 |
| JP | 9-82449 | A | 3/1997 |
| JP | 2001-291570 | A | 10/2001 |
| JP | 2002-343529 | A | 11/2002 |
| JP | 2004-335251 | A | 11/2004 |
| JP | 2007-311369 | A | 11/2007 |
| JP | 2008-547159 | A | 12/2008 |
| JP | 2010-123449 | A | 6/2010 |
| JP | 2011-210460 | A | 10/2011 |
| JP | 2012-216491 | A | 11/2012 |

OTHER PUBLICATIONS

Office Action dated Jul. 12, 2017 in Chinese Patent Application No. 201380073643.2 (with English language translation).
Written Opinion dated Apr. 1, 2014 in PCT/JP2013/085226 (with English language translation).
Office Action dated Apr. 23, 2014 in Japanese Patent Application No. 2014-508201 (with unedited computer generated English translation).
Office Action dated Jul. 1, 2014 in Japanese Patent Application No. 2014-508201 (with unedited computer generated English translation).
Combined Chinese Office Action and Search Report dated Jan. 3, 2017 in Chinese Patent Application No. 201380073643.2 (with English language translation).
Office Action dated Sep. 16, 2014 in Japanese Patent Application No. 2014-508201 (with unedited computer generated English translation).
Japanese Office Action dated Aug. 10, 2017 in Patent Application No. 2014-112738 (with English translation), 7 pages.
Japanese Office Action dated Feb. 5, 2018 in Patent Application No. 2014-112738 (with English translation), 4 pages.
Chinese Office Action dated Jul. 12, 2017 in Patent Application No. 201380073643.2 (with English translation), 3 pages.
Decision to Grant dated Jul. 30, 2018 in Japanese Patent Application No. 2014-112738 (with English translation), 5 pages.

* cited by examiner

METHOD OF MANUFACTURING CONNECTION STRUCTURE, WIRE HARNESS, AND DEVICE FOR MANUFACTURING CONNECTION STRUCTURE

TECHNICAL FIELD

The present invention relates to a method of manufacturing a connection structure formed by connecting a closed-barrel type crimp terminal to an insulated wire whose conductor is covered by an insulating covering, a device for manufacturing a connection structure, and a wire harness that uses a connection structure.

BACKGROUND

Electric components mounted in automobiles and the like form electric circuits by connecting to other electric components, power devices, and the like via wire harnesses that bundle insulated wires together. Here, connectors provided on the wire harness and provided on the electric component, the power device, and the like are mated with each other to connect the wire harness to the electric component, the power device, and the like. The interior of each connector is equipped with a connection structure in which a crimp terminal and an insulated wire have a crimp connection.

This connection structure is formed by inserting the insulated wire into the crimp terminal, which has a crimping portion that electrically connects a conductor in the insulated wire, and then swaging the crimping portion. As a result, the crimp terminal and the insulated wire are connected in a conductible manner.

Incidentally, increased functionality and performance in recent electric components has resulted in increasing complexity in electric circuits, and there is thus increased demand for reliable conductivity at crimping connection areas between respective crimp terminals and insulated wires. In opened-barrel type crimp terminals such as those employed thus far, crimping portions and conductors have been exposed, and thus in harsh usage environments, there has been a risk of the crimping portion surfaces and conductor surfaces in the crimping connection areas corroding and causing a drop in conductivity.

In response to such a problem, using the crimp terminal having a closed-barrel type crimping portion disclosed in paragraph [0005] of Patent Document 1, for example, provides a connection structure capable of preventing corrosion of the crimping portion surfaces and conductor surfaces in the crimping connection areas.

The crimp terminal disclosed in Patent Document 2, for example, has been disclosed as a closed-barrel type crimp terminal. The crimp terminal according to Patent Document 2 has a cylindrical crimping portion whose other end is closed on one side of a longitudinal direction, as illustrated in FIGS. 10 to 15 in Patent Document 2. By inserting a tip portion of an insulated wire into the cylindrical crimping portion and crimping the tip portion, it is thought that the crimp terminal according to the Patent Document 2 can ensure reliable conductivity between the crimp terminal and a conductor in the insulated wire and prevent corrosion of the crimping portion surface and conductor surface in the crimping connection area.

However, a crimp terminal having such a form cannot be obtained without being individually manufactured through a method such as casting. In other words, the crimp terminal cannot be manufactured by, for example, punching out a band-shaped copper plate and sequentially bending the copper during transport. Furthermore, connecting the insulated wire and forming the connection structure cannot be carried out while manufacturing the crimp terminal. As such, a closed-barrel type crimp terminal such as that disclosed in Patent Document 2 has had a problem in that the connection structure cannot be continuously and efficiently manufactured.

PRIOR ART DOCUMENT

Patent Document

Patent Document 1: Japanese Unexamined Patent Application Publication No. 2007-311369A Patent Document 2: U.S. Pat. No. 3,955,044

SUMMARY OF THE INVENTION

Technical Problem

An object of the present invention is to provide a method for manufacturing a connection structure, a wire harness, and a device for manufacturing a connection structure in which a connection structure having stable conductivity is efficiently manufactured by reliably crimping a conductor portion in a closed-barrel type crimping portion.

Solution to Problem

The present invention provides a method of manufacturing a connection structure, the connection structure connecting an insulated wire including a conductor covered by an insulating covering and an electric wire tip portion exposing the conductor on a tip side by the insulating covering being stripped from the tip side, to a crimp terminal including a closed-barrel type crimping portion allowing a crimp connection with the electric wire tip portion, by crimping the electric wire tip portion using the crimping portion. The method includes, in the following order: a carrier cutting step in which the crimp terminal is separated from a terminal connecting belt comprising the crimp terminal being coupled to a carrier formed in a band shape along a latitudinal direction of the carrier and a plurality of the crimp terminals being coupled at predetermined intervals in a longitudinal direction of the carrier; a wire insertion step in which at least the electric wire tip portion of the insulated wire is inserted into the crimping portion of the crimp terminal separated from the carrier; and a crimping step in which a crimp connection is formed by crimping the crimping portion into which the electric wire tip portion has been inserted. The crimping portion of the crimp terminal is held by holding means in the carrier cutting step. As the holding means, in the crimping step, the crimping portion is held by crimping means that crimp the crimping portion. The present invention also provides a manufacturing device that carries out the same steps.

The stated crimp terminal is a closed-barrel type terminal including a crimping portion having a hollow cross sectional shape, and includes a connection terminal having a connection portion that allows a connection with a connection portion of another terminal in a set of paired terminals, or a terminal constituted only of a crimping portion.

According to the present invention, a connection structure having stable conductivity can be efficiently manufactured by reliably crimping a conductor portion in a closed-barrel type crimping portion.

To describe in more detail, according to the method of manufacturing the connection structure and the device for manufacturing a connection structure, the insulated wire is inserted into the crimp terminal separated from the terminal connecting belt and crimped, and thus the crimp terminal into which the insulated wire is inserted can be supplied more efficiently than in a case where, for example, crimp terminals manufactured individually through a method such as casting are used. As such, the method of manufacturing the connection structure and the device for manufacturing a connection structure can manufacture the connection structure efficiently.

Meanwhile, in the case of a terminal connecting belt in which a plurality of crimp terminals having opened-barrel type crimping portions are disposed in a carrier formed in a band shape at predetermined intervals in the longitudinal direction of the carrier, a direction in which the crimp terminals are coupled with the carrier is different from a direction in which the insulated wire is inserted into the crimping portions. As such, for example, the insertion of the insulated wire into the crimping portion and the separation of the crimp terminal from the terminal connecting belt can be carried out simultaneously without separating means hindering the insertion of the insulated wire into the crimping portion when the crimp terminal is separated from the terminal connecting belt.

As opposed to this, according to a terminal connecting belt in which the closed-barrel type crimping portion is coupled with the carrier, the direction in which the crimp terminal is coupled with the carrier is the same as the direction in which the insulated wire is inserted into the crimping portion. As such, the separating means hinder the insertion of the insulated wire into the closed-barrel type crimping portion when the crimp terminal is separated from the terminal connecting belt. In addition, it is difficult to separate the closed-barrel type crimping portion into which the insulated wire is inserted from the terminal connecting belt without the insulated wire being damaged by the separating means.

However, according to the method of manufacturing the connection structure and the device for manufacturing a connection structure, the insulated wire is inserted into and crimped in the crimp terminal that is separated from the terminal connecting belt, and thus the connection structure can be manufactured efficiently without the separating means hindering the insertion of the insulated wire into the crimping portion.

Accordingly, the method of manufacturing the connection structure and the device for manufacturing the connection structure can efficiently manufacture the connection structure having a stable conductivity by reliably crimping the conductor portion in the closed-barrel type crimping portion.

As one aspect of the present invention, a cover stripping step in which the electric wire tip portion is formed by stripping the insulating covering from the tip side of the insulated wire disposed at a predetermined position can be carried out before the carrier cutting step.

According to the present invention, the connection structure can be manufactured even more efficiently.

To describe in more detail, according to the method of manufacturing the connection structure and the device for manufacturing the connection structure, carrying out the cover stripping step in which the electric wire tip portion is formed by stripping the insulating covering from a predetermined position of the tip side of the insulated wire, before the carrier cutting step, or in other words, disposing the insulated wire at a predetermined position, makes it possible to form the electric wire tip portion in which the conductor is exposed as well as carry out the subsequent series of processes.

Accordingly, the method of manufacturing the connection structure and the device for manufacturing the connection structure can carry out the subsequent processes in sequence simply by setting the insulated wire to be stripped in a predetermined position, for example. As such, the method of manufacturing the connection structure and the device for manufacturing the connection structure can manufacture the connection structure even more efficiently.

As another aspect of the present invention, a marking step in which a mark is applied on the insulating covering at a predetermined position based on a length of the electric wire tip portion inserted into the crimping portion can be carried out between the cover stripping step and the carrier cutting step, and a testing step in which a state of the crimping of the electric wire tip portion to the crimping portion is tested using the mark can be carried out after the crimping step.

Testing of the state of the crimping refers to testing items related to the quality of the connection structure, such as the conductivity and the durability thereof. The testing items includes, for example: testing whether or not the electric wire tip portion has been successfully inserted into the closed-barrel type crimping portion up to an insertion length of the electric wire tip portion, or in other words, up to a predetermined position; testing for the presence of wires folded back without being inserted into the crimping portion and exposed from the crimping portion; testing whether or not the insulated wire is bent relative to the crimping portion; and the like.

The testing also includes visual testing, as well as mechanical testing based on detection through image processing, sensors, or the like, for example.

According to the present invention, a high-quality connection structure capable of reliably ensuring conductivity, durability, and the like can be manufactured.

Specifically, when stripping the insulating covering in the cover stripping step, there are cases where the positions of the tip of the insulating covering and the tip of the conductor are skewed, for example. Accordingly, in the case where the marking step is carried out before the cover stripping step, setting the predetermined position on the basis of the length from the tip of the insulating covering may result in the position of the mark being different from a desired position after the cover stripping step. There is thus a risk that the length for the electric wire tip portion inserted into the crimping portion may be insufficient and the connection structure cannot be manufactured so as to ensure a stable conductivity.

As opposed to this, by carrying out the marking step after the cover stripping step, the method of manufacturing the connection structure and the device for manufacturing the connection structure can set the predetermined position on the basis of the length from the tip of the electric wire tip portion, and thus the mark can be accurately applied at the desired position.

Because the mark that has been applied in the marking step is used to test of the state of the crimping of the electric wire tip portion relative to the crimping portion after the crimping step, the method of manufacturing the connection structure and the device for manufacturing the connection structure can easily determine failures that cause a drop in conductivity, such as the electric wire tip portion being unable to be inserted into the closed-barrel type crimping portion up to the predetermined position, some of the wires that form the conductor catching and being folded back when the electric wire tip portion is inserted into the crimping portion and being crimped in such a state, and the like, for example, by using the mark applied to the insulating covering.

Furthermore, the method of manufacturing the connection structure and the device for manufacturing the connection structure can easily determine a failure that causes a drop in durability, such as the insulated wire being crimped in the crimping portion in a bent state, by using the mark applied to the insulating covering.

Accordingly, the method of manufacturing the connection structure and the device for manufacturing the connection structure can manufacture a high-quality connection structure capable of reliably ensuring conductivity, durability, and the like.

As another aspect of the present invention, the conductor can be formed from an aluminum-based material, and at least the crimping portion can be formed from a copper-based material.

The copper-based material can be formed from copper, a copper alloy, or the like, and the conductor formed from the aluminum-based material can be formed from an aluminum or aluminum alloy core wire, a twisted wire in which wires are twisted together, and the like.

According to the present invention, a lighter weight can be achieved compared to the weight of an insulated wire having a conductor formed from a copper wire, and the connection structure having a stable conductivity can be manufactured efficiently.

Incidentally, in the case where a copper-based material conventionally used for the conductor of the insulated wire is replaced with an aluminum-based material such as aluminum or an aluminum alloy and the aluminum-based material conductor is crimped in the crimp terminal, a phenomenon in which the aluminum-based material, which is a base metal, corrodes because of contact with a noble metal such as tin plating, gold plating, or a copper alloy of the terminal material, or in other words, experiences galvanic corrosion, can be a problem.

Note that galvanic corrosion is a phenomenon in which a corrosive current is produced when moisture adheres to an area where a noble metal and a base metal come into contact with each other, and the base metal corrodes, dissolves, disappears, and the like. Because of this phenomenon, the aluminum-based material conductor crimped in the crimping portion of the crimp terminal corrodes, dissolves, and disappears, ultimately causing an electrical resistance to rise. There has thus been a problem in that sufficient conductive functionality cannot be achieved.

As opposed to this, by sealing an opening of the closed-barrel type crimping portion using a separate sealing member or through swaging, the method of manufacturing the connection structure can easily ensure waterproof performance with respect to moisture penetrating into the crimping portion. Accordingly, the method of manufacturing the connection structure can manufacture the connection structure so as to prevent what is known as galvanic corrosion, while achieving a lighter weight than that of an insulated wire whose conductor is formed from a copper-based material.

As such, the method of manufacturing the connection structure can manufacture the connection structure that has a lighter weight and is capable of ensuring stable conductivity, regardless of the type of metal used to form the conductor of the insulated wire.

The present invention also provides wire harness including a plurality of the connection structures, manufactured by the aforementioned method of manufacturing a connection structure, bundled together, the crimp terminals of the connection structures being mounted within a connector housing.

According to the present invention, a wire harness that ensures a favorable conductivity can be formed by using the connection structures that ensure stable conductivity and are manufactured efficiently.

Effect of the Invention

According to the present invention, a method for manufacturing a connection structure, a wire harness, and a device for manufacturing a connection structure in which a connection structure having stable conductivity is efficiently manufactured by reliably crimping a conductor portion in a closed-barrel type crimping portion can be provided.

DESCRIPTION OF EMBODIMENTS

An embodiment of the present invention will be described below with reference to the drawings.

First, a connection structure 1 according to the present embodiment will be described in detail using FIGS. 1 to 4.

Figure 1A:
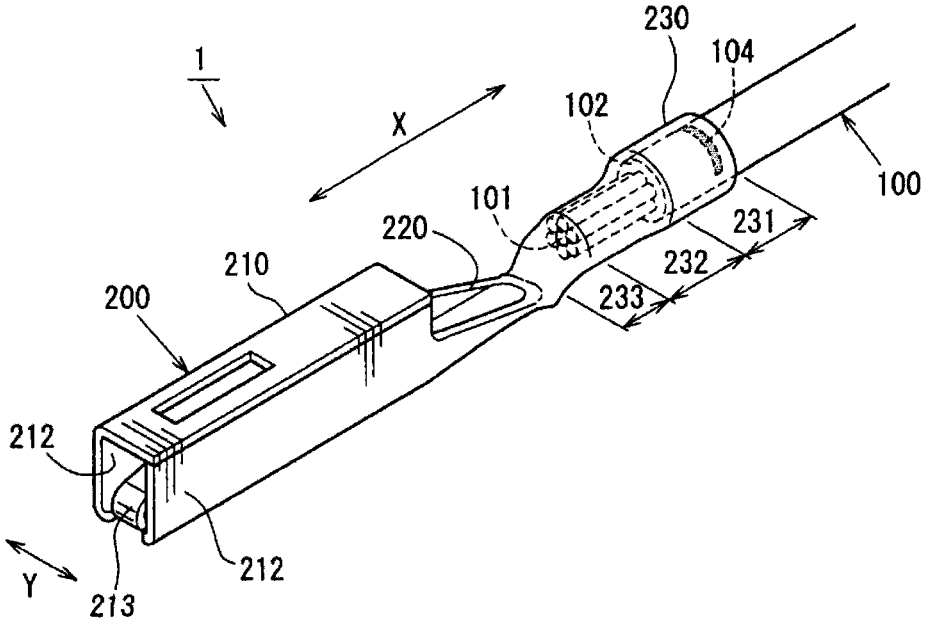
FIGS. 1A and 1B are explanatory diagrams illustrating a connection structure.
Figure 1B:
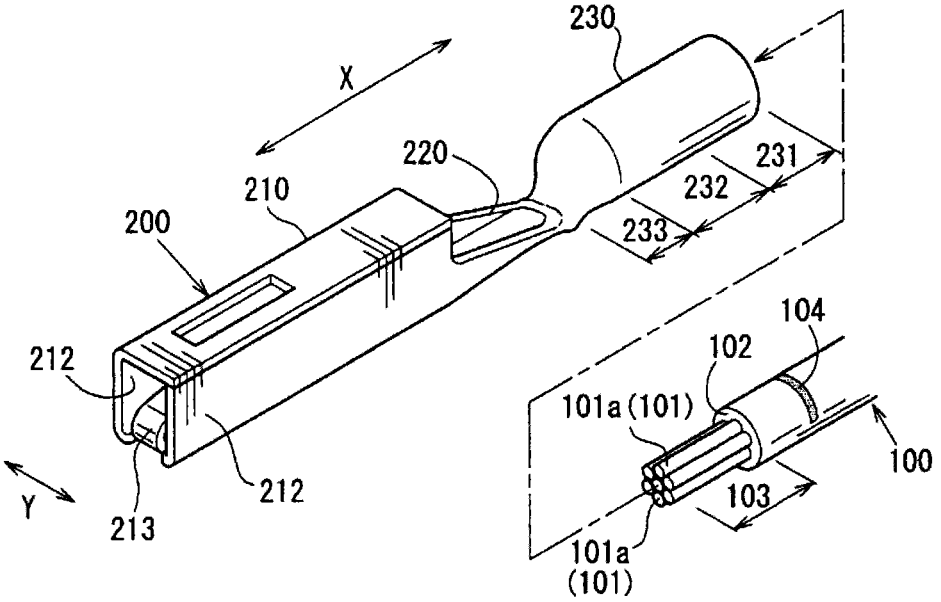
Figure 2:
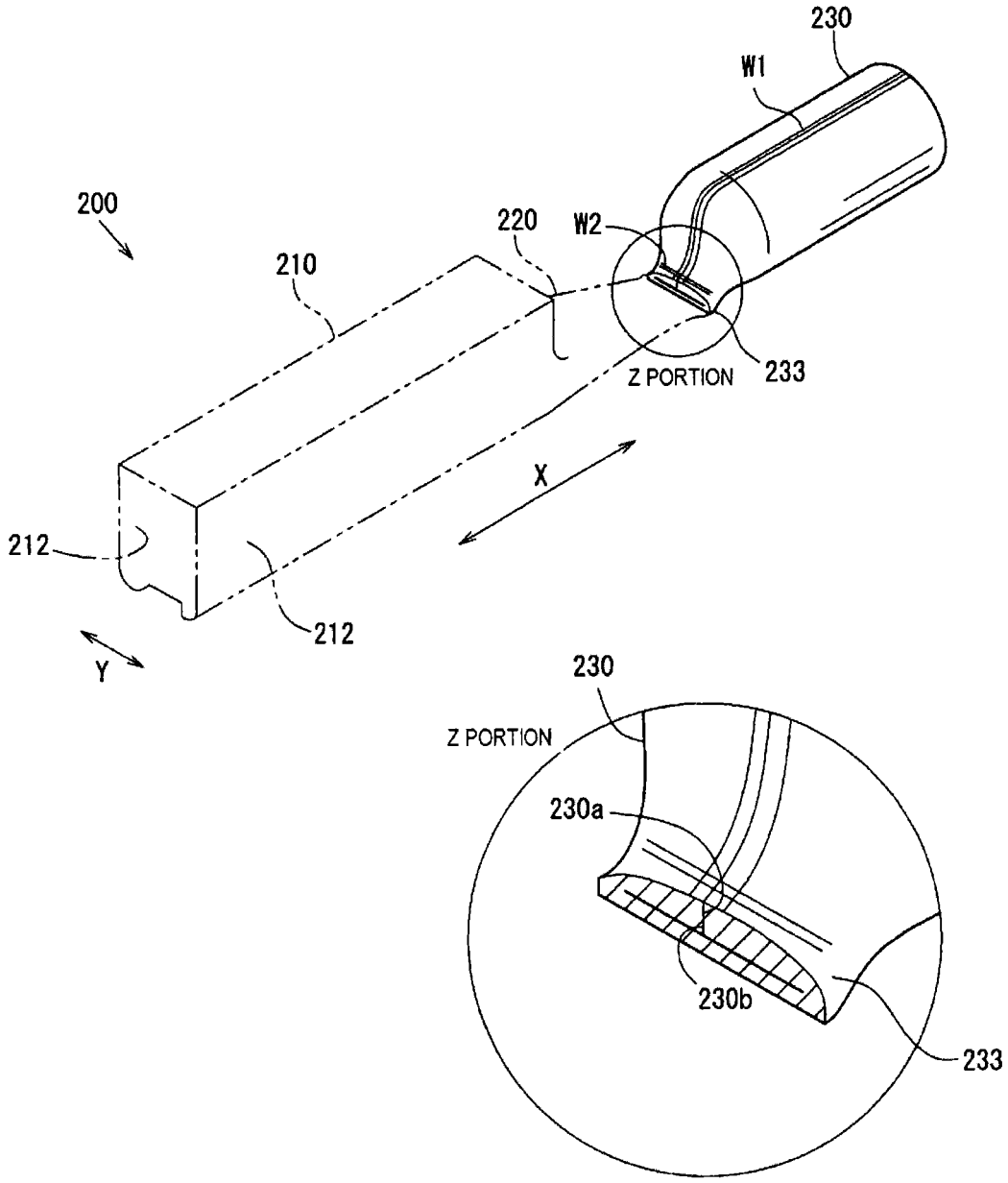
FIG. 2 is an explanatory diagram illustrating welding at a crimping portion.
Figure 3:
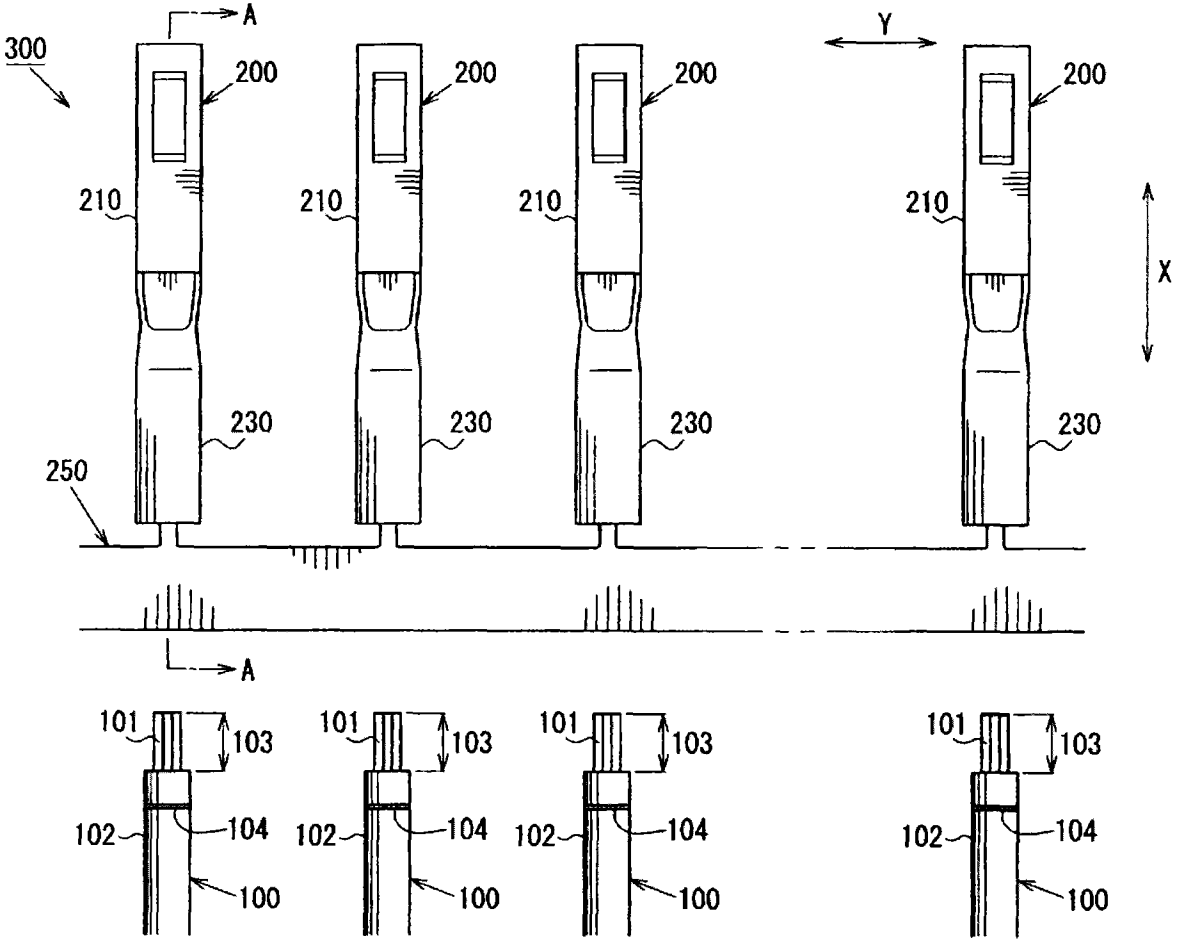
FIG. 3 is a plan view illustrating, from above, the external appearance of a terminal connecting belt and insulated wire.
Figure 4:
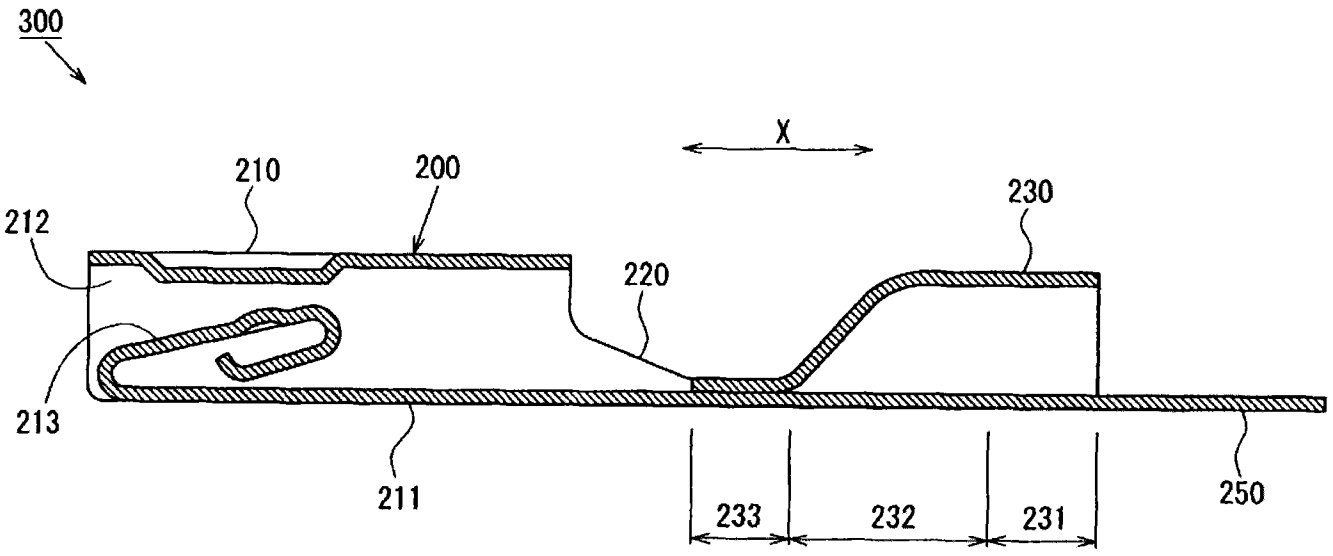
FIG. 4 is a cross-sectional view taken along the A-A arrow illustrated in FIG. 3.

FIGS. 1A and 1B are explanatory diagrams illustrating the connection structure 1, FIG. 2 is an explanatory diagram illustrating welding at a crimping portion 230, FIG. 3 is a plan view illustrating a terminal connecting belt 300 and an insulated wire 100 from above, and FIG. 4 is a cross-sectional view taken along the A-A arrow illustrated in FIG. 3. Furthermore, FIG. 1A is an external perspective view illustrating the connection structure 1 from the upper-front, and FIG. 1B is an external perspective view illustrating the insulated wire 100 and a crimp terminal 200 that constitute the connection structure 1 from the upper-front.

In FIGS. 1A and 1B, an arrow X indicates a longitudinal direction (hereinafter, referred to as a "longitudinal direction X"), and an arrow Y indicates a width direction (hereinafter, referred to as a "width direction Y"). Furthermore, a side of a box portion 210, which is mentioned later, in the longitudinal direction X (the left side in FIGS. 1A and 1B) is taken as forward, and a side of the insulated wire 100, which is mentioned later, relative to the box portion 210 in the longitudinal direction X (the right side in FIGS. 1A and 1B) is taken as rearward. In addition, an upper side in FIGS. 1A and 1B is taken as upward, and a lower side in FIGS. 1A and 1B is taken as downward.

As illustrated in FIG. 1A, the connection structure 1 is formed by crimp-connecting the insulated wire 100 and the crimp terminal 200.

As illustrated in FIG. 1B, the insulated wire 100 is formed by covering an aluminum core wire 101, in which a plurality of aluminum wires 101*a* are bundled together, with an insulating covering 102 constituted of an insulating resin. The aluminum core wire 101 is formed by, for example, twisting aluminum alloy wires to a cross-sectional size of 0.75 $mm^2$.

Furthermore, an electric wire tip portion 103 is formed by removing the insulating covering 102 from the insulated wire 100 from a tip thereof to a predetermined length in the longitudinal direction X and exposing the aluminum core wire 101. In addition, a substantially line-shaped mark 104 is provided around the circumference of the insulated wire 100 in an upper-side surface of the insulating covering 102 of the insulated wire 100, at a position a predetermined length from a tip of the electric wire tip portion 103. The mark 104 will be described in detail later.

As illustrated in FIGS. 1A and 1B, the crimp terminal 200 is a female terminal, and is formed by integrating the box portion 210 that allows a male tab of a male terminal (not illustrated) to be inserted from forward to rearward in the longitudinal direction X with the crimping portion 230 disposed rearward from the box portion 210, with a transition portion 220 of a predetermined length disposed therebetween.

The crimp terminal 200 is a closed-barrel type terminal formed by punching out a flat, unfolded terminal shape from a copper alloy strip (not illustrated) formed of brass or the like whose surface is tin plated (Sn plated), then carrying out a bending process to form a three-dimensional terminal shape formed from the box portion 210, which is a hollow quadrangular prism, and the crimping portion 230, which has a substantially ○ shape when seen in a rear view, and then welding the crimping portion 230.

As illustrated in FIGS. 1A to 2, the box portion 210 is formed as a substantially rectangular inverted hollow quadrangular prism when viewed from the front in the longitudinal direction X, by bending one of side face portions 212, provided on both side portions of a base surface portion 211 in the width direction Y orthogonal to the longitudinal direction X, so as to overlap with other end portions.

Furthermore, an elastic contact piece 213 that makes contact with an insertion tab (not illustrated) of an inserted male terminal is provided within the box portion 210, and is formed by bending a portion of the base surface portion 211, that extends forward in the longitudinal direction X, rearward in the longitudinal direction X (see FIG. 4).

As illustrated in FIGS. 1A to 2 and 4, the crimping portion 230 is constituted of a covering crimping portion 231 that crimps the insulating covering 102, a conductor crimping portion 232 that crimps the electric wire tip portion 103, and a sealing portion 233 that is deformed so as to compress an end portion forward from the conductor crimping portion 232 into a substantially plate shape, with these elements being formed integrally.

As illustrated in FIG. 2, the crimping portion 230 is formed having a substantially ○ shape when seen in a rear view, and is formed by rounding a copper alloy strip punched out in a terminal shape so as to have substantially the same outer diameter as the insulated wire 100 or an inner diameter slightly greater than the outer diameter of the insulated wire 100 in order to enclose an outer periphery of the insulated wire 100, with rounded end portions 230*a* and 230*b* pressed together and welded along a welding location W1 in the longitudinal direction X. To rephrase, the crimping portion 230 is formed so that a cross-sectional shape thereof in the width direction Y has a closed cross-section.

Furthermore, as illustrated in FIGS. 2 and 4, the sealing portion 233 of the crimping portion 230 is welded along a welding location W2 in the width direction Y and sealed so as to close off a forward end of the crimping portion 230 in the longitudinal direction X.

In other words, the crimping portion 230 is formed in a substantially cylindrical shape having an opening rearward in the longitudinal direction X, by welding and closing off a forward end of the crimping portion 230 in the longitudinal direction X and the end portions 230*a* and 230*b* together.

The terminal connecting belt 300 is configured by coupling a plurality of the crimp terminals 200 to a belt-like carrier 250 that takes the width direction Y of the crimp terminal 200 as a longitudinal direction. More specifically, in the terminal connecting belt 300, when taken in plan view, rearward lower ends of the crimping portions 230 in the crimp terminals 200 are coupled with the carrier 250 so as to substantially match a latitudinal direction orthogonal to the longitudinal direction of the carrier 250 relative to the longitudinal direction X that corresponds to the longitudinal direction of the crimp terminal 200, as illustrated in FIGS. 3 and 4. The terminal connecting belt 300 couples with the plurality of crimp terminals 200 at predetermined intervals in the longitudinal direction of the carrier 250.

This terminal connecting belt 300 is configured with a plurality of crimp terminals 200 coupled together by subjecting a substantially plate-shaped copper alloy strip to a punching process, and then, in the resulting copper alloy strip formed in a shape in which the belt-like carrier 250 and a flat, unfolded terminal shape portion are connected, bending the terminal shape portion into a three-dimensional terminal shape.

A manufacturing device 10 that manufactures the connection structure 1 by crimp-connecting the crimp terminal 200 in the terminal connecting belt 300 with the insulated wire 100, and a manufacturing process for manufacturing the connection structure 1, will be described in detail using FIGS. 5 to 9.

Figure 5:
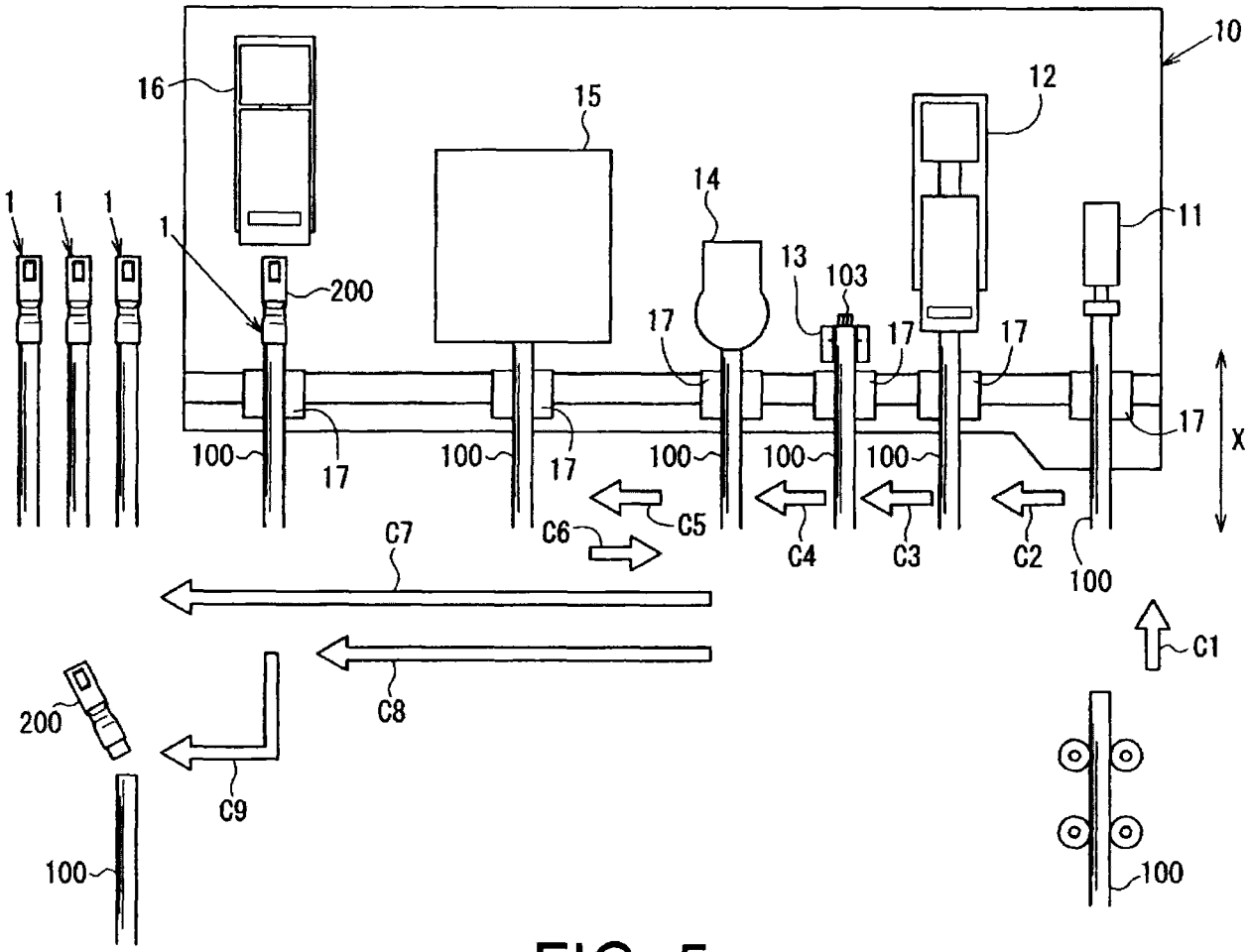
FIG. 5 is a plan view illustrating, from above, the external appearance of a manufacturing device.
Figure 6:
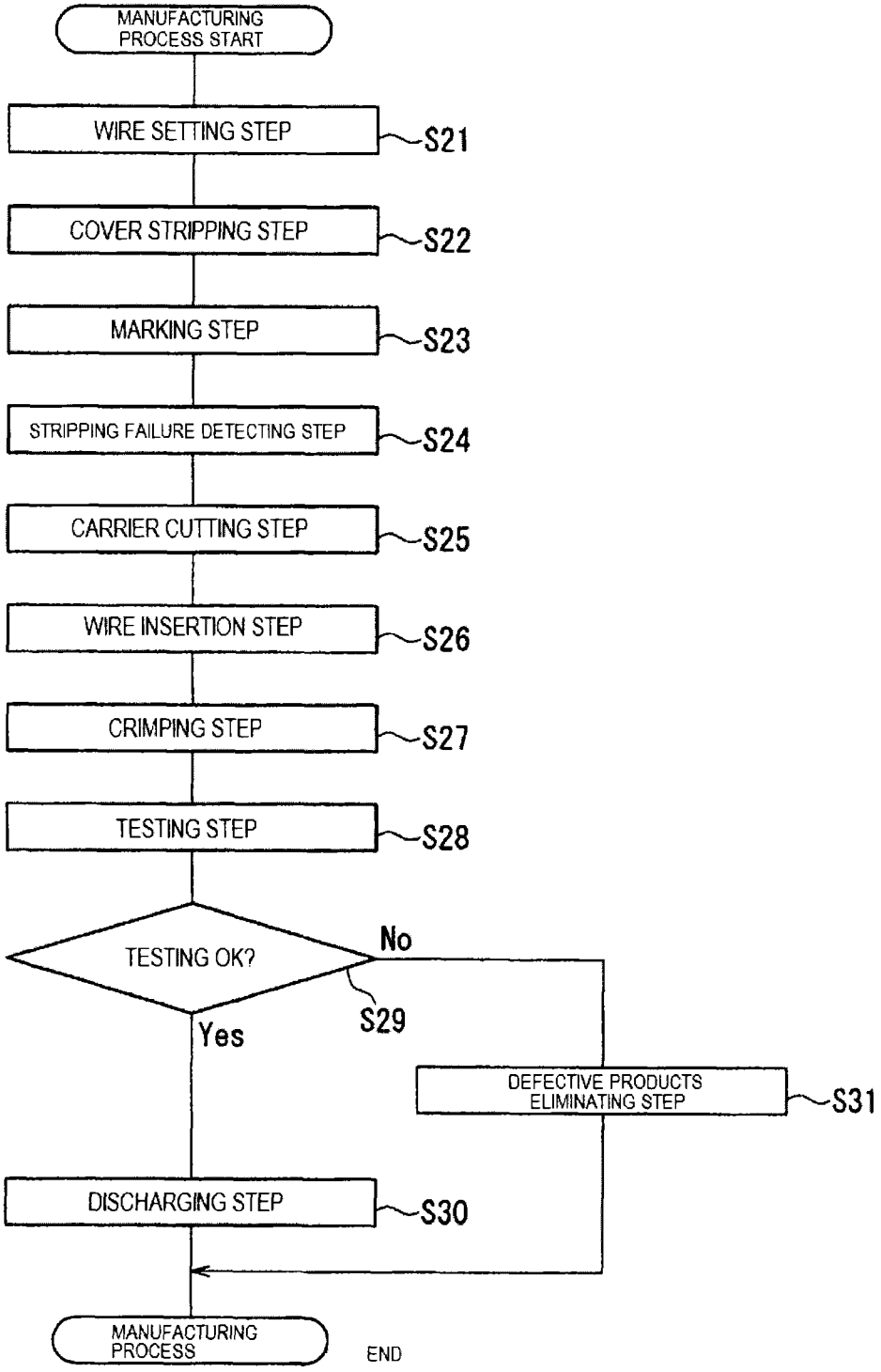
FIG. 6 is a flowchart illustrating operations in a manufacturing process.
Figure 7A:
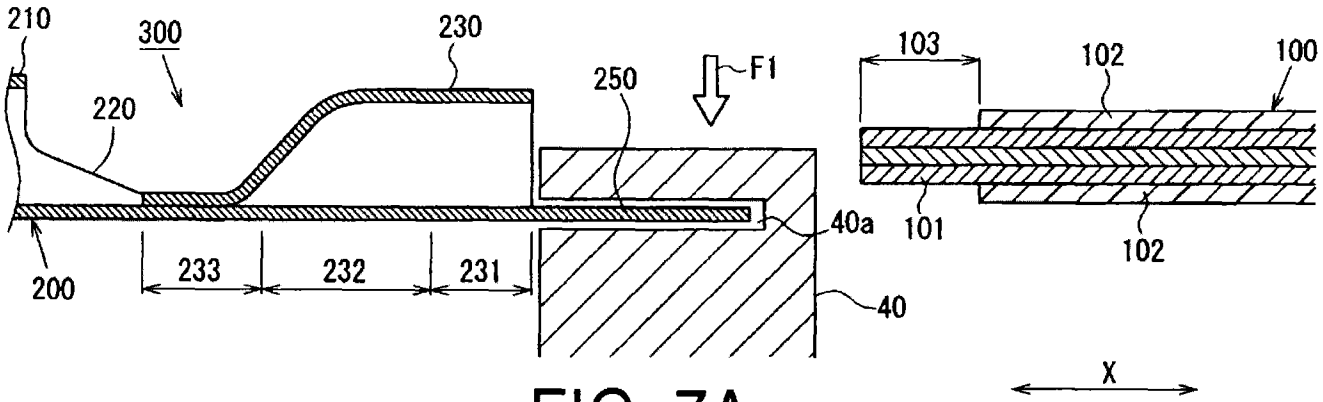
FIGS. 7A and 7B are explanatory diagrams illustrating a carrier cutting step carried out by a crimping processing portion.
Figure 7B:
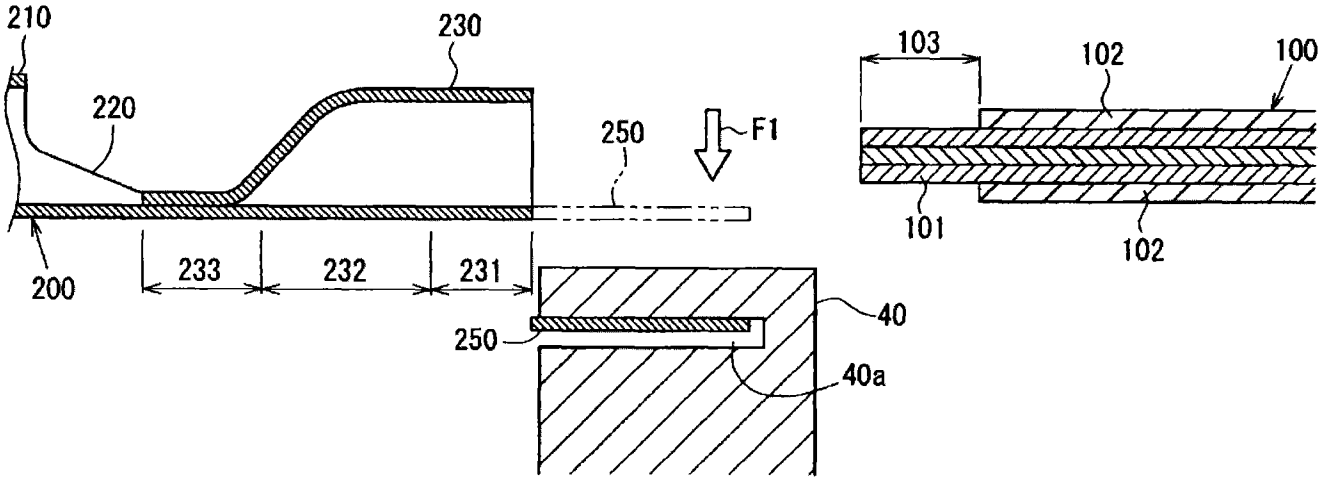
Figure 8A:
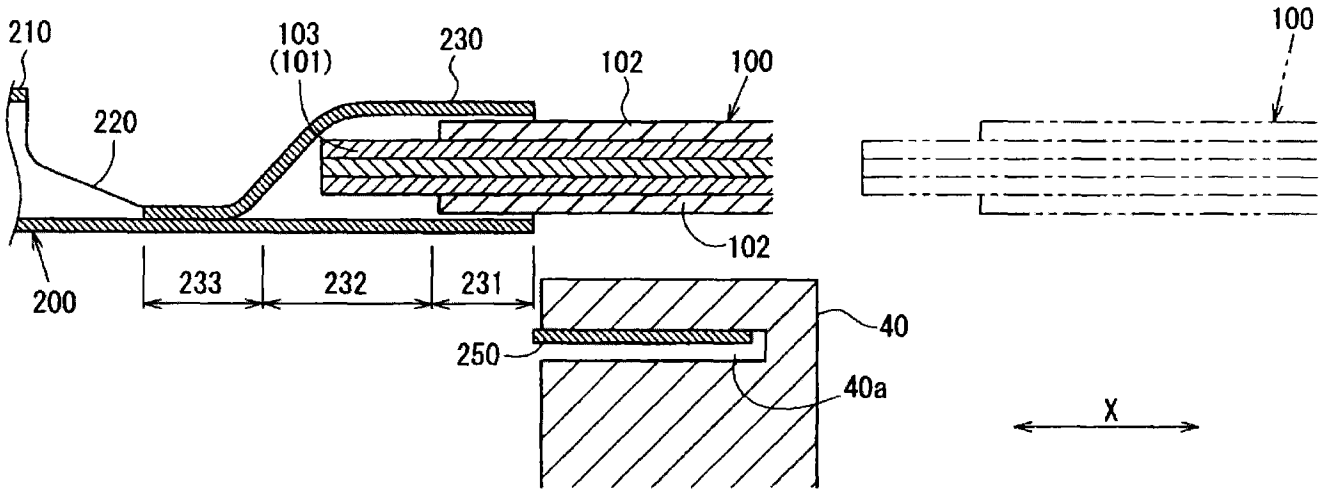
FIGS. 8A and 8B are explanatory diagrams illustrating a wire insertion step carried out by the crimping processing portion.
Figure 8B:
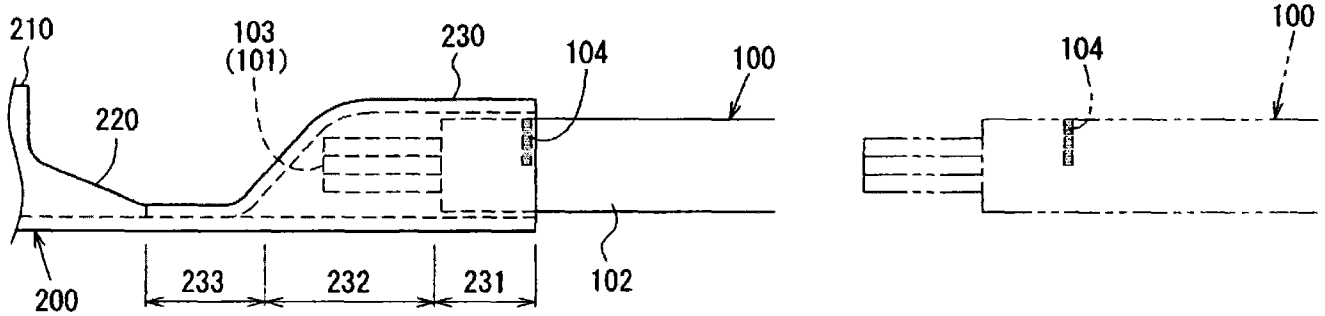
Figure 9A:
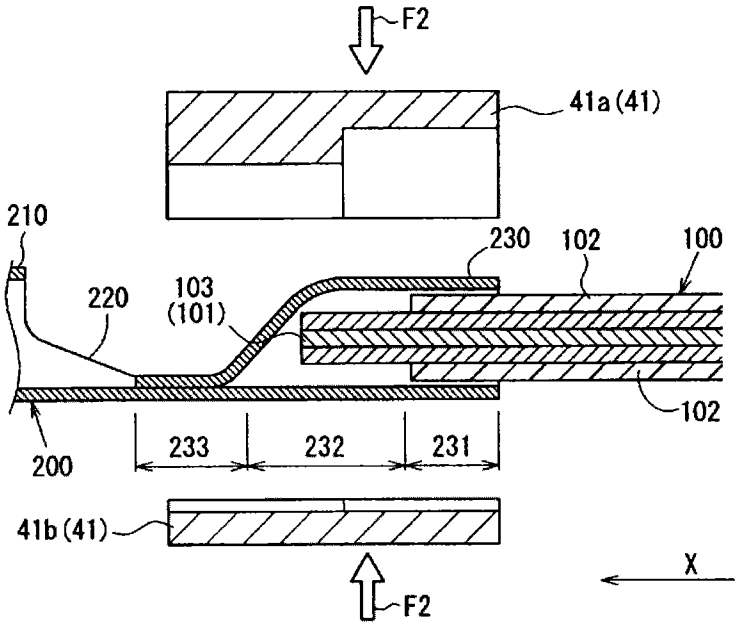
FIGS. 9A and 9B are explanatory diagrams illustrating crimping step carried out by the crimping processing portion.
Figure 9B:
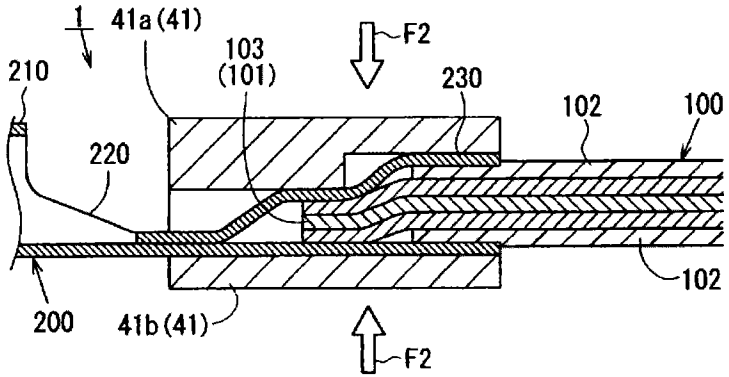

FIG. 5 is a plan view illustrating the manufacturing device 10 from above, FIG. 6 is a flowchart illustrating operations in the manufacturing process, FIGS. 7A and 7B are explanatory diagrams illustrating a carrier cutting step carried out by a crimping processing portion 15, FIGS. 8A and 8B are explanatory diagrams illustrating a wire insertion step carried out by the crimping processing portion 15, and FIGS. 9A and 9B are explanatory diagrams illustrating a crimping step carried out by the crimping processing portion 15.

Although not illustrated in detail in FIG. 6, in the manufacturing process operations, it is assumed that a transporting processing portion 17, described later, carries out the transporting step for transporting the insulated wire 100 and the connection structure 1 to the next step in between each step.

Meanwhile, FIG. 7A is a cross-sectional view illustrating a first stage of the carrier cutting step, FIG. 7B is a cross-sectional view illustrating a final stage of the carrier cutting step, FIG. 8A is a cross-sectional view illustrating the wire insertion step, FIG. 8B is a side view illustrating the wire insertion step, FIG. 9A is a cross-sectional view illustrating a first stage of the crimping step, and FIG. 9B is a cross-sectional view illustrating a final stage of the crimping step. Furthermore, in FIGS. 7A to 9B, the box portion 210 of the crimp terminal 200 is not illustrated to make the primary elements more recognizable.

First, the manufacturing device 10 that manufactures the connection structure 1 is configured by disposing a tip detection processing portion 11, a cover stripping processing portion 12, a marking processing portion 13, a testing processing portion 14, the crimping processing portion 15, and a defective products eliminating processing portion 16 in that order, as illustrated in FIG. 5. Note that the manufacturing device 10 includes the transporting processing portion 17, serving as transporting means that transport the insulated wire 100 and the connection structure 1, that is configured to be capable of moving between the tip detection processing portion 11 and the defective products eliminating processing portion 16.

The tip detection processing portion 11 is constituted by a contact sensor or the like, and has a function of detecting a position of the tip of the transported insulated wire 100.

The cover stripping processing portion 12 is constituted by, for example, a cover eliminating blade (not illustrated) having a substantially V-shaped cross-section divided into upper and lower portions, a moving mechanism (not illustrated) that moves the cover eliminating blade in a predetermined direction, and the like, and has a function of exposing the aluminum core wire 101 by removing a predetermined length of the insulating covering 102 from the tip of the transported insulated wire 100.

The marking processing portion 13 is constituted by a paint tank (not illustrated), an ejection port (not illustrated) for ejecting paint, and the like, and has a function of applying a mark by ejecting the paint onto the insulated wire 100 at a predetermined position.

The testing processing portion 14 is constituted by an image sensor (not illustrated), and has a function of obtaining image data by capturing an image of the vicinity of the tip of the transported insulated wire 100 from above and detecting a state of the vicinity of the tip of the insulated wire 100 on the basis of the captured image data.

The crimping processing portion 15 is constituted by a transporting mechanism (not illustrated) that transports the terminal connecting belt 300, a holding mechanism (not illustrated) that holds the box portion 210, a crimping blade 41 (see FIGS. 9A and 9B) that crimps the crimping portion 230, a separating blade 40 (see FIGS. 7A and 7B) that separates the crimp terminal 200 from the terminal connecting belt 300, a moving mechanism (not illustrated) that moves the crimping blade 41 and the separating blade 40 in a predetermined direction, and the like. The crimping processing portion 15 has a function of transporting the terminal connecting belt 300, a function of separating the crimp terminal 200 from the transported terminal connecting belt 300, and a function of crimping the insulated wire 100 that has been inserted into the crimping portion 230.

As illustrated in FIGS. 9A and 9B, the crimping blade 41 is divided vertically into an upper blade 41*a* and a lower blade 41*b*, and when the two blades come together in a vertical direction, an inner surface shape that corresponds to an outer shape of the crimping portion 230 when in a state of the crimping is formed.

Meanwhile, as illustrated in FIGS. 7A and 7B, the separating blade 40 is formed having a substantially rectangular cross-section that partially blocks the opening of the crimping portion 230 in the crimp terminal 200, and has a slit portion 40*a* into which the carrier 250 of the terminal connecting belt 300 is inserted.

The defective products eliminating processing portion 16 is constituted by a cutting blade (not illustrated) that cuts the insulated wire 100, a moving mechanism (not illustrated) that moves the cutting blade in a predetermined direction, and the like, and has a function of cutting the insulated wire 100 for a connection structure 1 whose state of the crimping or the like has been determined to be defective.

The transporting processing portion 17 is constituted by a holding mechanism (not illustrated) that holds the insulated wire 100, a moving mechanism (not illustrated) that moves the holding mechanism, and the like, and has a function of holding the insulated wire 100, a function of transporting the held insulated wire 100 to each of the stated processes, and a function of transporting the insulated wire 100 in the longitudinal direction X. Upon the tip of the insulated wire 100 being detected in a wire setting step, which will be described later, the transporting processing portion 17 transports the insulated wire 100 until the connection structure 1 is discharged from the manufacturing device 10 without re-clamping the insulated wire 100.

Next, operations in the manufacturing process for manufacturing the connection structure 1 using the manufacturing device 10 will be described.

When the manufacturing process starts, the transporting processing portion 17 moves the insulated wire 100 in a transporting direction C1 and transports the insulated wire 100 to the tip detection processing portion 11 as illustrated in FIG. 5, in response to an instruction from the manufacturing device 10.

Then, the manufacturing device 10 starts the wire setting step that sets a position of the insulated wire 100 relative to the manufacturing device 10 in the longitudinal direction X, as illustrated in FIG. 6 (step S21). Specifically, in response to an instruction from the manufacturing device 10, the transporting processing portion 17 moves the insulated wire 100 forward in the longitudinal direction X of the insulated wire 100, or in other words, toward the tip detection processing portion 11, until the tip detection processing portion 11 detects the tip of the insulated wire 100, as illustrated in FIG. 5.

Upon the tip detection processing portion 11 detecting the tip of the insulated wire 100, the transporting processing portion 17 transports the insulated wire 100 to the cover stripping processing portion 12 by moving the insulated wire 100 in a transporting direction C2 while maintaining the longitudinal direction X position of the insulated wire 100 relative to the manufacturing device 10.

After the insulated wire 100 is transported to the cover stripping processing portion 12, the manufacturing device 10 starts a cover stripping step that strips the insulating covering 102 from the insulated wire 100, as illustrated in FIG. 6 (step S22). Specifically, in response to an instruction from the manufacturing device 10, the cover stripping processing portion 12 moves toward the insulated wire 100 that is held stationary by the transporting processing portion 17 and pinches a position a predetermined length from the tip of the insulated wire 100 using the cover eliminating blade.

The electric wire tip portion 103 is then formed by the cover stripping processing portion 12 moving in a direction away from the insulated wire 100, stripping away a portion of the insulating covering 102 using the cover eliminating blade, and exposing the aluminum core wire 101. Upon the insulating covering 102 being stripped away, the transporting processing portion 17 transports the insulated wire 100 to the marking processing portion 13 by moving the insulated wire 100 in a transporting direction C3 in response to an instruction from the manufacturing device 10 while maintaining the longitudinal direction X position of the insulated wire 100 relative to the manufacturing device 10, as illustrated in FIG. 5.

After the insulated wire 100 is transported to the marking processing portion 13, the manufacturing device 10 starts a marking step that applies the mark 104 to the insulating covering 102, as illustrated in FIG. 6 (step S23). Specifically, in response to an instruction from the manufacturing device 10, the marking processing portion 13 detects a position a predetermined length from the tip of the electric wire tip portion 103 in the longitudinal direction X, and forms the mark 104 by applying paint around the circumference of the insulated wire 100 at that position.

Note that the position a predetermined length from the electric wire tip portion 103 is assumed to be a position of the insulating covering 102 corresponding to an inner rear end of the crimping portion 230 when the insulated wire 100 is inserted into the crimping portion 230.

After the mark 104 is formed on the insulating covering 102, the transporting processing portion 17 transports the insulated wire 100 to the testing processing portion 14 by moving the insulated wire 100 in a transporting direction C4 in response to an instruction from the manufacturing device 10 while maintaining the longitudinal direction X position of the insulated wire 100 relative to the manufacturing device 10, as illustrated in FIG. 5.

After the insulated wire 100 is transported to the testing processing portion 14, the manufacturing device 10 starts the stripping failure detecting step that detects a cover stripping state, as illustrated in FIG. 6 (step S24). Specifically, in response to an instruction from the manufacturing device 10, the testing processing portion 14 obtains image data by capturing an image of the vicinity of the tip of the insulated wire 100 and detects a stripping state of the insulating covering 102, a frayed condition of the aluminum core wire 101 at the electric wire tip portion 103, or the like on the basis of the obtained image data, as illustrated in FIG. 5.

At this time, in the case of a failure such as where a desired length of the insulating covering 102 is not removed, or in other words, where the electric wire tip portion 103 is not a desired length, the manufacturing device 10 discards the insulated wire 100. Meanwhile, in the case where the stripping state of the insulating covering 102 is correct and there is no failure, the transporting processing portion 17 transports the insulated wire 100 to the crimping processing portion 15 by moving the insulated wire 100 in a transporting direction C5 in response to an instruction from the manufacturing device 10 while maintaining the longitudinal direction X position of the insulated wire 100 relative to the manufacturing device 10, as illustrated in FIG. 5.

After the insulated wire 100 is transported to the crimping processing portion 15, the manufacturing device 10 starts the carrier cutting step that separates the crimp terminal 200 from the terminal connecting belt 300, as illustrated in FIG. 6 (step S25). Specifically, in response to an instruction from the manufacturing device 10, the crimping processing portion 15 transports the terminal connecting belt 300 to the interior of the crimping processing portion 15 and transports the terminal connecting belt 300 so that the opening of the crimping portion 230 in the crimp terminal 200 and the insulated wire 100 oppose each other, as illustrated in FIG. 7A.

At this time, the crimping processing portion 15 transports the terminal connecting belt 300 so that the carrier 250 thereof enters into the slit portion 40*a* of the separating blade 40. Then, after holding the box portion 210, the crimping processing portion 15 moves the separating blade 40 in a separating direction F1 and presses the carrier 250 in the separating direction F1 using the slit portion 40*a*, as illustrated in FIG. 7B. As a result, the crimping processing portion 15 shears the carrier 250 from the terminal connecting belt 300, and separates the crimp terminal 200 and the carrier 250.

After the crimp terminal 200 and the carrier 250 are separated, the manufacturing device 10 starts the wire insertion step that inserts the insulated wire 100 into the crimp terminal 200, as illustrated in FIG. 6 (step S26). Specifically, in response to an instruction from the manufacturing device 10, the transporting processing portion 17 moves the insulated wire 100 forward in the longitudinal direction X by a predetermined distance and inserts the insulated wire 100 into the crimping portion 230 of the crimp terminal 200 whose box portion 210 is held, as illustrated in FIG. 8A.

At this time, the transporting processing portion 17 inserts the insulated wire 100 into the crimping portion 230 with a radial direction center of the crimping portion 230 aligned with a radial direction center of the insulated wire 100, or using a guide member configured as a separate entity so that the radial direction center of the insulated wire 100 substantially matches the radial direction center of the crimping portion 230.

In the case where the electric wire tip portion 103 of the insulated wire 100 has been correctly inserted into the crimping portion 230 of the crimp terminal 200, the mark 104 on the insulated wire 100 is positioned within the crimping portion 230, as illustrated in FIG. 8B.

After the insulated wire 100 is inserted into the crimping portion 230, the manufacturing device 10 starts the crimping step that crimps the crimp terminal 200 whose box portion 210 is held and the insulated wire 100, as illustrated in FIG. 6 (step S27). Specifically, in response to an instruction from the manufacturing device 10, the crimping processing portion 15 swages the crimping portion 230 by pinching the crimping portion 230 using the crimping blade 41 that has been moved in a crimping direction F2, crimp-connects the electric wire tip portion 103 and the conductor crimping portion 232 so as to be conductive with each other, and swages the covering crimping portion 231, thus forming the connection structure 1, as illustrated in FIGS. 9A and 9B. The crimping processing portion 15 then releases the hold on the box portion 210.

After the crimp terminal 200 separated from the terminal connecting belt 300 is crimp-connected to the insulated wire 100, the transporting processing portion 17 transports the connection structure 1 to the testing processing portion 14 in response to an instruction from the manufacturing device 10 by moving the connection structure 1 in a transporting direction C6, as illustrated in FIG. 5.

After the connection structure 1 is transported to the testing processing portion 14, the manufacturing device 10 starts a testing step that determines whether or not the state of the crimping of the connection structure 1 is correct, as illustrated in FIG. 6 (step S28). Specifically, in response to an instruction from the manufacturing device 10, the testing processing portion 14 obtains image data by capturing an image of the vicinity of the crimping portion 230 of the connection structure 1, and detects the quality of the state of the crimping at the crimping portion 230 on the basis of the obtained image data.

For example, whether or not there is breakage in the crimping portion 230 is detected from the image data, and a crimping failure is determined to have occurred in the case where there is breakage. Alternatively, in the case where the mark 104 is exposed from the crimping portion 230, a crimping failure, in which the length of the insulated wire 100 inserted into the crimping portion 230 is too short and the crimping has been carried out with the electric wire tip portion 103 not reaching the conductor crimping portion 232, is determined to have occurred. Alternatively, the quality of the state of the crimping is determined by detecting a height and/or a width of the crimping portion 230 in the state of the crimping and comparing those with respective predetermined values.

In the case where the state of the crimping of the connection structure 1 is correct (Yes in step S29), the manufacturing device 10 determines that the connection structure 1 is a normal product, and starts a discharging step that discharges the connection structure 1 from the manufacturing device 10 (step S30). Specifically, in response to an instruction from the manufacturing device 10, the transporting processing portion 17 moves the connection structure 1 in a transporting direction C7 and discharges the connection structure 1 as a completed product from the manufacturing device 10 to a predetermined location.

Meanwhile, in the case where the state of the crimping of the connection structure 1 is defective (No in step S29), the transporting processing portion 17 transports the connection structure 1 to the defective products eliminating processing portion 16 in response to an instruction from the manufacturing device 10 by moving the connection structure 1 in a transporting direction C8, as illustrated in FIG. 5.

After the connection structure 1 is transported to the defective products eliminating processing portion 16, the manufacturing device 10 starts a defective products eliminating step that separates the connection structure 1 from normal products and eliminates the connection structure 1 (step S31). Specifically, in response to an instruction from the manufacturing device 10, the defective products eliminating processing portion 16 moves toward the insulated wire 100 held stationary by the transporting processing portion 17, cuts the insulated wire 100 at a position a predetermined length from the tip of the connection structure 1 using the cutting blade, and separates the crimp terminal 200 in the state of the crimping, as illustrated in FIG. 5.

Then, the transporting processing portion 17 moves the insulated wire 100 whose crimp terminal 200 has been cut away in a transporting direction C9, and separates and discharges the insulated wire 100 to a different location than the normal products.

After the connection structure 1 separated on the basis of the quality of the state of the crimping being discharged to a predetermined location and the crimp connections between all of the crimp terminals 200 and insulated wires 100 is completed, the manufacturing device 10 ends the manufacturing process.

Figure 10:
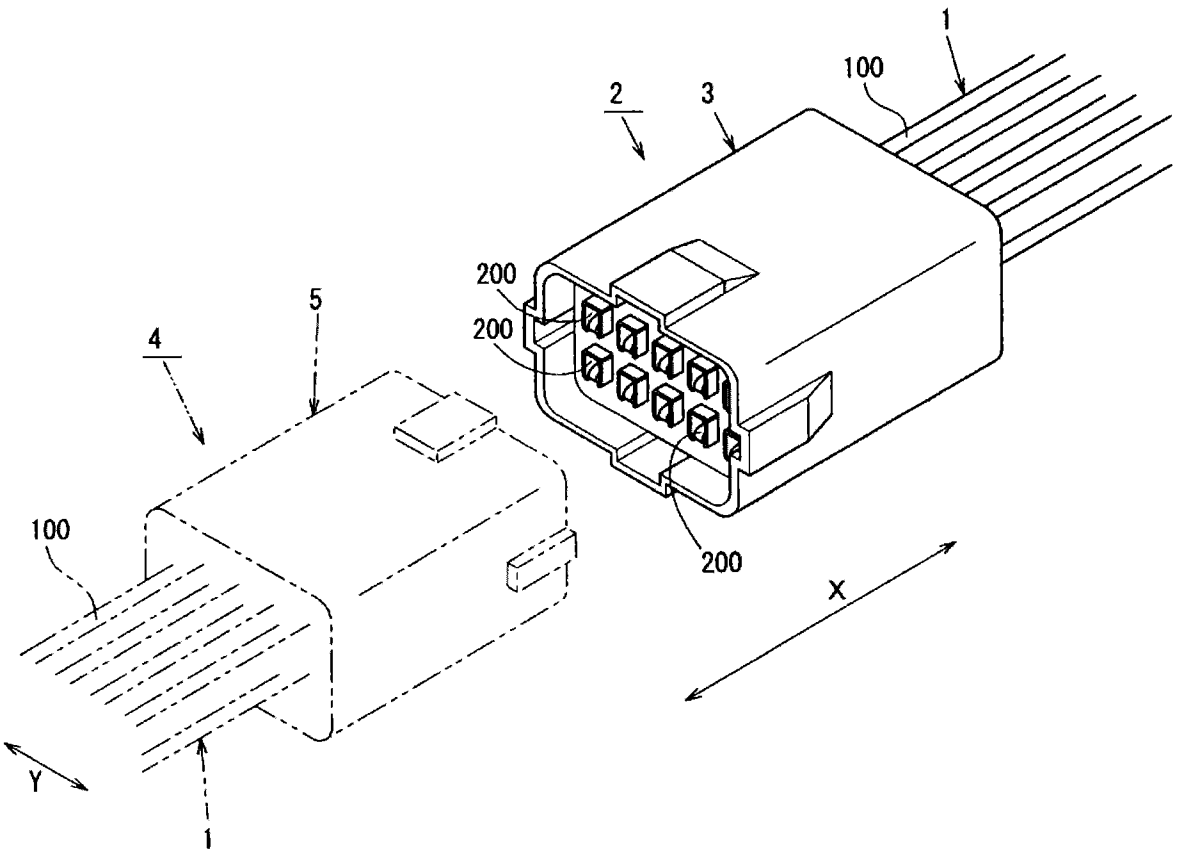
FIG. 10 is an external perspective view illustrating a connection alignment state of a wire harness.

A wire harness 2 is formed by bundling together a plurality of the connection structures 1 manufactured in this manner and mounting the crimp terminals 200 within a connector housing 3, for example, as illustrated in FIG. 10.

FIG. 10 is an external perspective view of a connection alignment state between the wire harness 2 and a wire harness 4, and the wire harness 4 is illustrated by a long and two short dashes line in FIG. 10.

More specifically, the wire harness 2 is constituted by a plurality of the connection structures 1 and the female connector housing 3.

The female connector housing 3 has in its interior a plurality of cavities into which the crimp terminals 200 can be mounted along the longitudinal direction X, and is formed so that a cross-sectional shape in the width direction Y is a substantially rectangular box-shape. The wire harness 2 is formed by mounting the plurality of connection structures 1 constituted by the aforementioned crimp terminals 200 within the female connector housing 3 along the longitudinal direction X.

The wire harness 4 that is mated with the wire harness 2 includes a male connector housing 5 that corresponds to the female connector housing 3. Like the female connector housing 3, the male connector housing 5 has a plurality of openings in which crimp terminal can be mounted, has a substantially rectangular cross-sectional shape in the width direction Y, and is formed so that non-planarities therein correspond to the female connector housing 3 and the male connector housing 5 can be connected to the female connector housing 3.

The wire harness 4 is formed by mounting connection structures 1 constituted by male crimp terminals (not illustrated) within the male connector housing 5 along the longitudinal direction X.

The wire harness 2 and the wire harness 4 are connected by mating the female connector housing 3 with the male connector housing 5.

The method of manufacturing the connection structure 1 realized through the aforementioned operations, and the manufacturing device 10 for the connection structure 1, can efficiently manufacture the connection structure 1 having a stable conductivity by reliably crimping the electric wire tip portion 103 in the closed-barrel type crimping portion 230.

To describe in more detail, according to the method of manufacturing the connection structure 1 and the manufacturing device 10 for the connection structure 1, the insulated wire 100 is inserted into the crimp terminal 200 separated from the terminal connecting belt 300 and crimped, and thus the crimp terminal 200 into which the insulated wire 100 is inserted can be supplied more efficiently than in a case where, for example, crimp terminals manufactured individually through a method such as casting are used. As such, the method of manufacturing the connection structure 1 and the manufacturing device 10 for the connection structure 1 can manufacture the connection structure 1 efficiently.

Meanwhile, in the case of a terminal connecting belt in which a plurality of crimp terminals having opened-barrel type crimping portions is disposed in a carrier formed in a band shape at predetermined intervals in the longitudinal direction of the carrier, a direction in which the crimp terminals are coupled with the carrier is different from a direction in which the insulated wire 100 is inserted into the crimping portions. As such, for example, the insertion of the insulated wire 100 into the crimping portion and the separation of the crimp terminal from the terminal connecting belt can be carried out simultaneously without the separating blade 40 hindering the insertion of the insulated wire 100 into the crimping portion when the crimp terminal is separated from the terminal connecting belt.

As opposed to this, according to the terminal connecting belt 300 in which the closed-barrel type crimping portion 230 is coupled with the carrier 250, the direction in which the crimp terminal 200 is coupled with the carrier 250 is the same as the direction in which the insulated wire 100 is inserted into the crimping portion 230. As such, the separating blade 40 hinders the insertion of the insulated wire 100 into the closed-barrel type crimping portion 230 when the crimp terminal 200 is separated from the terminal connecting belt 300. In addition, it is difficult to separate the closed-barrel type crimping portion 230 into which the insulated wire 100 is inserted from the terminal connecting belt 300 without the insulated wire 100 being damaged by the separating blade 40.

However, according to the method of manufacturing the connection structure 1 and the manufacturing device 10 for the connection structure 1, the insulated wire 100 is inserted into and crimped in the crimp terminal 200 that is separated from the terminal connecting belt 300, and thus the connection structure 1 can be manufactured efficiently without the separating blade 40 hindering the insertion of the insulated wire 100 into the crimping portion 230.

Accordingly, the method of manufacturing the connection structure 1 and the manufacturing device 10 for the connection structure 1 can efficiently manufacture the connection structure 1 having a stable conductivity by reliably crimping the electric wire tip portion 103 in the closed-barrel type crimping portion 230.

Meanwhile, the connection structure 1 can be even more efficiently manufactured by carrying out the cover stripping step and the carrier cutting step first.

To describe this in detail, according to the method of manufacturing the connection structure 1 and the manufacturing device 10 for the connection structure 1, carrying out the cover stripping step, which forms the electric wire tip portion 103 by stripping the insulating covering 102 from a predetermined position of the tip side of the insulated wire 100, before the carrier cutting step, or in other words, disposing the insulated wire 100 at a predetermined position, makes it possible to form the electric wire tip portion 103 in which the aluminum core wire 101 is exposed as well as carry out the subsequent series of processes.

Accordingly, the method of manufacturing the connection structure 1 and the manufacturing device 10 for the connection structure 1 can carry out the subsequent processes in sequence simply by setting the insulated wire 100 to be stripped in a predetermined position, for example. As such, the method of manufacturing the connection structure 1 and the manufacturing device 10 for the connection structure 1 can manufacture the connection structure 1 even more efficiently.

Meanwhile, a high-quality connection structure 1 capable of reliably ensuring conductivity, durability, and the like can be manufactured by carrying out the marking step between the cover stripping step and the carrier cutting step and carrying out the testing step after the crimping step.

Specifically, when stripping the insulating covering 102 through the cover stripping step, there are cases where the positions of the tip of the insulating covering 102 and the tip of the aluminum core wire 101 are skewed, for example. Accordingly, in the case where the marking step is carried out before the cover stripping step, setting the predetermined position on the basis of the length from the tip of the insulating covering 102 may result in the position of the mark 104 being different from a desired position after the cover stripping step. There is thus a risk that the length for the electric wire tip portion 103 inserted into the crimping portion 230 may be insufficient and the connection structure 1 cannot be manufactured so as to ensure a stable conductivity.

As opposed to this, by carrying out the marking step after the cover stripping step, the method of manufacturing the connection structure 1 and the manufacturing device 10 for the connection structure 1 can set the predetermined position on the basis of the length from the tip of the electric wire tip portion 103, and thus the mark 104 can be accurately applied at the desired position.

Because the mark 104 applied in the marking step is used to test the state of the crimping of the electric wire tip portion 103 relative to the crimping portion 230 after the crimping step, the method of manufacturing the connection structure 1 and the manufacturing device 10 for the connection structure 1 can easily determine failures that cause a drop in conductivity, such as the electric wire tip portion 103 being unable to be inserted into the closed-barrel type crimping portion 230 up to the predetermined position, and some of the aluminum wires 101*a* that form the aluminum core wire 101 catching and being folded back when the electric wire tip portion 103 is inserted into the crimping portion 230 and being crimped in such a state, for example, by using the mark 104 applied to the insulating covering 102.

Furthermore, the method of manufacturing the connection structure 1 and the manufacturing device 10 for the connection structure 1 can easily determine a failure that causes a drop in durability, such as the insulated wire 100 being crimped in the crimping portion 230 in a bent state, by using the mark 104 applied to the insulating covering 102.

Accordingly, the method of manufacturing the connection structure 1 and the manufacturing device 10 for the connection structure 1 can manufacture a high-quality connection structure 1 capable of reliably ensuring conductivity, durability, and the like.

Meanwhile, by forming the conductor of the insulated wire 100 from an aluminum alloy and forming the crimping portion 230 from a copper alloy, a lighter weight can be achieved compared to that of an insulated wire having a conductor formed from a copper wire, and the connection structure 1 having a stable conductivity can be manufactured efficiently.

Furthermore, because the forward opening of the closed-barrel type crimping portion 230 is sealed using the sealing portion 233 and the covering crimping portion 231 pressurizes the insulating covering 102 in the state of the crimping, the method of manufacturing the connection structure 1 can easily ensure waterproof performance with respect to moisture penetrating into the crimping portion 230. Accordingly, the method of manufacturing the connection structure 1 can manufacture the connection structure 1 so as to prevent what is known as galvanic corrosion, while achieving a lighter weight than that of an insulated wire 100 whose conductor is formed from a copper alloy.

As such, the method of manufacturing the connection structure 1 can manufacture the connection structure 1 that has a lighter weight and is capable of ensuring stable conductivity, regardless of the type of metal used to form the conductor of the insulated wire 100.

Meanwhile, by bundling together a plurality of the connection structures 1 manufactured through the aforementioned method of manufacturing the connection structure 1 and mounting the crimp terminals 200 of the connection structures 1 within the female connector housing 3, the wire harness 2 can be formed so as to ensure a favorable conductivity by using the connection structures 1 that ensure stable conductivity and are manufactured efficiently.

Although the aforementioned embodiment describes the core wire of the insulated wire 100 as being an aluminum alloy, the invention is not limited thereto, and a core wire formed from a copper alloy such as brass, a core wire in which an outer peripheral surface of an aluminum alloy is covered by a copper alloy, a core wire formed from a suitable conductive metal wire, or the like may be employed.

In addition, although the crimp terminal 200 is described as being formed from a copper alloy such as brass, the invention is not limited thereto, and the crimp terminal 200 may be formed from an aluminum alloy, a suitable conductive metal, or the like.

In addition, although the crimp terminal 200 is described as a female crimp terminal, the invention is not limited thereto, and the crimp terminal 200 may be a male crimp terminal that mates with a female crimp terminal in the longitudinal direction X. Rather than the box portion 210, a substantially U-shaped or ring-shaped plate or the like may be employed. Alternatively, the crimp terminal 200 may be constituted only by the crimping portion 230.

In addition, although the crimping portion 230 is described as being formed by pressing together and welding the end portions 230*a* and 230*b* formed by rounding a copper alloy strip punched out in a terminal shape, the invention is not limited thereto, and the crimping portion may be formed in a closed cross-sectional shape by overlapping and welding the end portions 230*a* and 230*b* together.

Figure 11A:
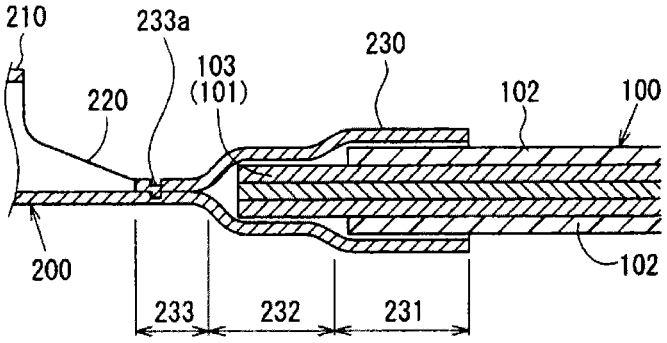
FIGS. 11A to 11C are cross-sectional views of another crimping portion taken along an A-A arrow.

In addition, although the crimping portion 230 is described as being formed in a cylindrical shape, the invention is not limited thereto, and any suitable shape may be used as long as it is a closed cross-sectional shape into which the insulated wire 100 can be inserted. For example, as illustrated in FIGS. 11A to 11C, which are cross-sectional views of the crimping portion 230 taken along an A-A arrow, the crimping portion 230 may have a stepped shape in which the diameter of the covering crimping portion 231 and the diameter of the conductor crimping portion 232 are different.

In addition, although the sealing portion 233 is described as being formed on a front end of the crimping portion 230, the invention is not limited thereto, and the front end of the crimping portion 230 may be sealed using a separate member. Alternatively, as illustrated in FIG. 11A, the sealing portion 233 may be formed by compressing an end portion forward from the conductor crimping portion 232 into a substantially plate shape so as to be integrated with a groove 233*a* compressed into a substantially recess shape along the width direction Y.

Figure 11B:
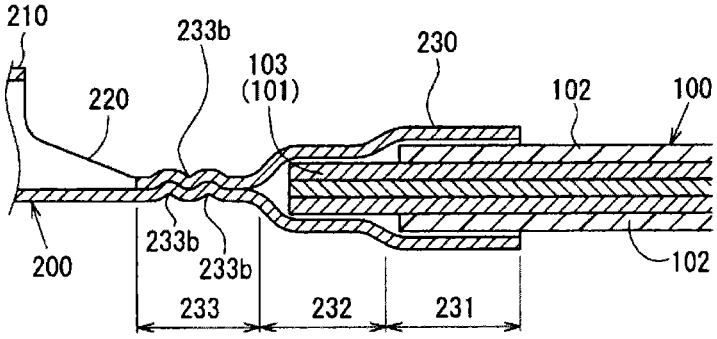
Figure 11C:
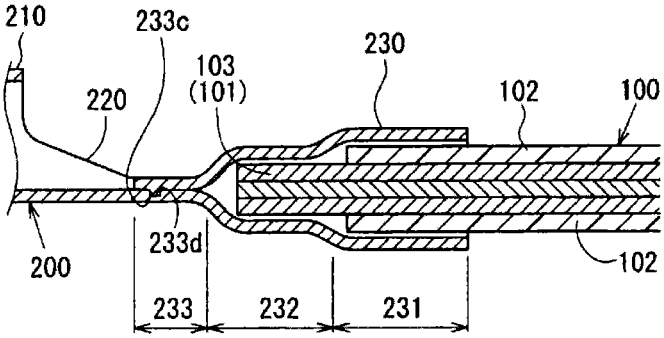

Alternatively, as illustrated in FIG. 11B, the sealing portion 233 may be formed by compressing the end portion forward from the conductor crimping portion 232 into a substantially wavy shape and realizing a seal by a plurality of grooves 233*b* formed along the width direction Y. Furthermore, as illustrated in FIG. 11C, a tenon 232*c* and a tenon groove 232*d* may be provided, and the sealing portion 233 may be formed by compressing the end portion forward from the conductor crimping portion 232 so that the tenon 232*c* fits into the tenon groove 233*d*. Note that the sealing portion 233 may be omitted, with the crimping portion being open on both ends thereof in the longitudinal direction X.

In addition, although the terminal connecting belt 300 is described as being formed by coupling the rearward lower end of the crimping portion 230 in the crimp terminal 200 with the carrier 250, the invention is not limited thereto, and the terminal connecting belt 300 may be formed by coupling the carrier 250 to any desired location of the rearward end of the crimping portion 230 or to any desired location of the forward end of the box portion 210. Alternatively, in the case where the crimp terminal is constituted only by the crimping portion 230, the terminal connecting belt 300 may be formed by coupling the carrier 250 with any desired location of the forward end of the crimping portion 230 or any desired location of the rearward end of the crimping portion 230.

In addition, although the mark 104 is described as being formed by applying paint to the insulating covering 102, the invention is not limited thereto, and the mark may be formed by discoloring a surface of the insulating covering 102 using a laser, applying a sticker to the insulating covering 102, or the like. Note also that the mark is not limited to a single mark, and a plurality of marks may be provided in the longitudinal direction X, for example.

In addition, although the mark 104 is described as being provided in a position corresponding to an inner rear end of the crimping portion 230, the invention is not limited thereto, and the mark 104 may be provided in a position exposed from the rear end of the crimping portion 230 in a correct state of the crimping. Furthermore, a plurality of marks 104 may be provided. In this case, in the testing step carried out in step S29 of FIG. 6, the state of the crimping may be tested using the positions, numbers, and the like of the marks 104, which can be confirmed from the exterior. For example, in the case where marks 104 are provided so that one is positioned within the crimping portion 230 and the other is in a position exposed from the crimping portion 230 upon the insulated wire 100 being inserted into the crimping portion 230, in the testing step of step S29, it can be determined that an insufficient length of the insulated wire 100 is inserted into the crimping portion 230 upon both the marks 104 being detected, and it can be determined that the insulated wire 100 has been inserted too far into the crimping portion 230 upon neither of the marks 104 being detected.

In addition, although the wire setting step is described as being carried out by the tip detection processing portion 11 and the cover stripping step is described as being carried out by the cover stripping processing portion 12, the invention is not limited thereto, and the wire setting step and the cover stripping step may be carried out in that order using the same apparatus.

In addition, although the transporting step is described as being carried out between each of the other steps, the invention is not limited thereto, and the transporting step may be carried out at any suitable timing in accordance with the configuration of the manufacturing device 10. For example, in the case of a configuration in which the cover stripping processing portion 12 moves relative to the insulated wire 100 whose tip position has been detected by the tip detection processing portion 11 and carries out the cover stripping step, the transporting step between the wire setting step and the cover stripping step may be unnecessary.

In addition, although the cover stripping step is described as being carried out before the carrier cutting step, the cover stripping step may be carried out before the wire insertion step.

In addition, although the state of the crimping is described as being tested by the testing processing portion 14 using image data, the invention is not limited thereto, and the state of the crimping may be tested visually or the like.

In addition, although the testing processing portion 14 is described as carrying out the testing on the basis of image data captured of the transported insulated wire 100 from above, the invention is not limited thereto, and the configuration may be such that the testing is carried out on the basis of image data captured of the front of the transported insulated wire 100.

In addition, although the stripping state of the insulating covering 102, the frayed condition of the aluminum core wire 101, and the like are described as being tested in the stripping failure detecting step, the invention is not limited thereto, and an exposed length of the electric wire tip portion 103, the position of the mark 104, or the like may also be subjected to the testing.

In addition, the crimping processing portion 15 may carry out the carrier cutting step (step S25 in FIG. 6), the wire insertion step (step S26 in FIG. 6), and the crimping step (step S27 in FIG. 6) in tandem with each other, using an appropriate method.

For example, upon the carrier cutting step starting, the crimping blade 41 may start moving in tandem with the movement of the separating blade 40 (see FIGS. 7A and 7B), and after the crimp terminal 200 separates from the terminal connecting belt 300, the wire insertion step may be started and the insulated wire 100 inserted into the crimping portion 230. Then, after the insulated wire 100 is inserted, the crimping of the crimping portion 230 may be started. As a result, the separating of the crimp terminal 200 from the terminal connecting belt 300 and the crimping of the insulated wire 100 to the crimping portion 230 can be carried out more efficiently.

In addition, although the crimping processing portion 15 is described as separating the crimp terminal 200 from the terminal connecting belt 300 in the vertical direction of the crimp terminal 200 using the separating blade 40 and crimping the insulated wire 100 in the crimping portion 230 using the crimping blade 41, the invention is not limited thereto, and the crimp terminal 200 may be separated from the terminal connecting belt 300 in the width direction Y of the crimp terminal 200 using the separating blade 40 and the insulated wire 100 may be crimped in the crimping portion 230 using the crimping blade 41.

Even in this case, the separating of the crimp terminal 200 from the terminal connecting belt 300 and the crimping of the insulated wire 100 to the crimping portion 230 can be carried out more efficiently, without damaging the insulated wire 100.

In addition, although the crimping processing portion 15 is described as holding the box portion 210, the invention is not limited thereto, and any desired location in the crimp terminal 200, such as the transition portion 220, may be held instead.

Alternatively, the crimping portion 230 may be held by the crimping blade 41. Specifically, in the carrier cutting step (step S25 of FIG. 6), the crimping portion 230 in the crimp terminal 200 of the terminal connecting belt 300 may be lightly pinched and held by the crimping blade 41.

In this state, the separating blade 40 is moved in the separating direction F1, and the manufacturing device 10 separates the terminal connecting belt 300 into the carrier 250 and the crimp terminal 200. Then, with the crimping portion 230 still held by the crimping blade 41, the manufacturing device 10 starts the wire insertion step (step S26 of FIG. 6) and inserts the insulated wire 100 into the crimping portion 230. Then, in the crimping step (step S27 of FIG. 6), the manufacturing device 10 swages the crimping portion 230 so as to be held by the crimping blade 41, and crimps the crimp terminal 200 and the insulated wire 100 together in a conductive state.

As a result, the method of manufacturing the connection structure 1 and the manufacturing device 10 for the connection structure 1 can suppress fluctuations in the position of the crimping portion 230 caused by the carrier cutting step, deformation in the vicinity of the transition portion 220, and the like, as compared to the case where the box portion 210 is held. In other words, the method of manufacturing the connection structure 1 and the manufacturing device 10 for the connection structure 1 can more reliably place the crimping portion 230 at a predetermined position. Accordingly, the method of manufacturing the connection structure 1 and the manufacturing device 10 for the connection structure 1 can prevent failures such as the electric wire tip portion 103 making contact with an opening end portion of the crimping portion 230 from occurring in the wire insertion step.

Furthermore, because a holding mechanism that holds the box portion 210 is unnecessary, the method of manufacturing the connection structure 1 and the manufacturing device 10 for the connection structure 1 can allow for a simpler configuration of the crimping processing portion 15, and can carry out the processes from the carrier cutting step to the crimping step more efficiently. In addition, even in the case where the crimp terminal is constituted only by the crimping portion 230, the method of manufacturing the connection structure 1 and the manufacturing device 10 for the connection structure 1 can easily continue to hold the crimping portion 230 that has been separated from the carrier 250 at the predetermined position.

The configuration of the invention corresponds to the aforementioned embodiment in the following ways.

That is, a conductor according to the invention corresponds to the aluminum core wire 101 according to the embodiment;

and similarly:

a latitudinal direction of a carrier corresponds to the longitudinal direction X;

a longitudinal direction of the carrier corresponds to the width direction Y;

the carrier cutting step corresponds to step S25;

the wire insertion step corresponds to step S26;

the crimping step corresponds to step S27;

the cover stripping step corresponds to step S22;

the marking step corresponds to step S23;

the testing step corresponds to step S28;

carrier cutting means correspond to the crimping processing portion 15 and the separating blade 40;

electric wire insertion means correspond to the transporting processing portion 17;

crimping means correspond to the crimping processing portion 15 and the crimping blade 41;

cover stripping means correspond to the cover stripping processing portion 12;

marking means correspond to the marking processing portion 13;

testing means correspond to the testing processing portion 14; and a connector housing corresponds to the female connector housing 3 and the male connector housing 5.

However, the invention is not intended to be limited to the configurations in the aforementioned embodiment, and many other embodiments can also be employed.

Figure 12:
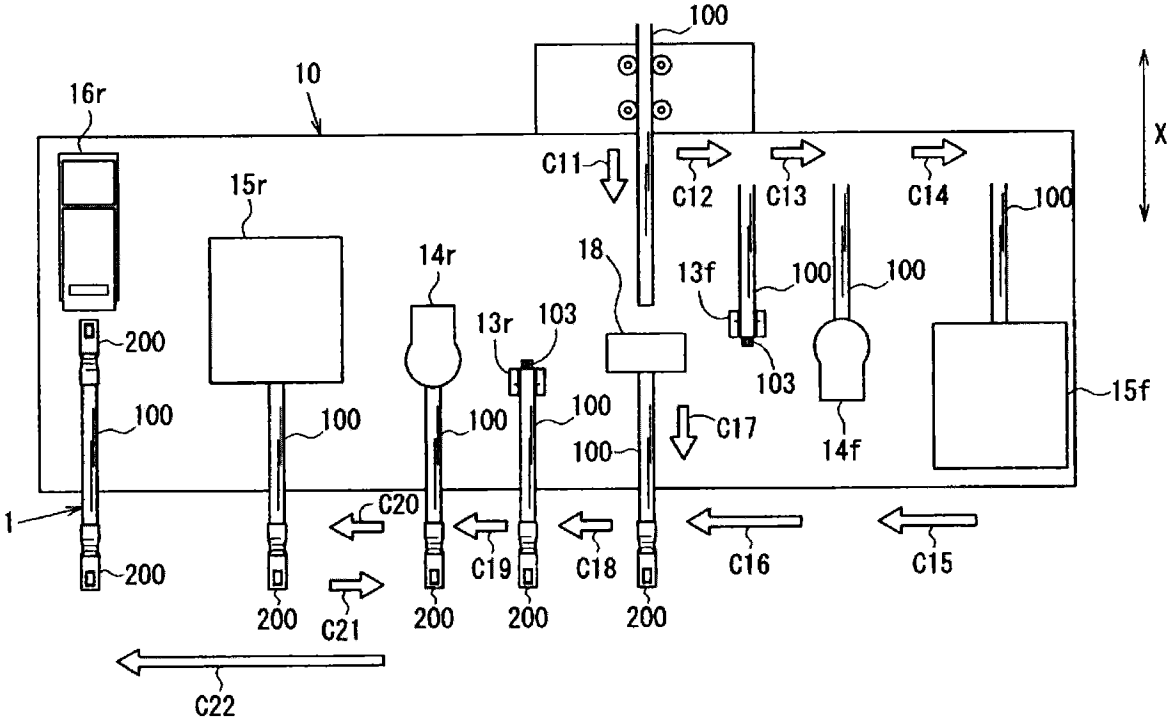
FIG. 12 is a plan view illustrating, from above, the external appearance of another device for manufacturing a connection structure.

For example, as illustrated in FIG. 12, which is a plan view illustrating another manufacturing device 10 for a connection structure 1, the manufacturing device 10 may be capable of crimping the crimp terminal 200 at both ends of the insulated wire 100 in the longitudinal direction X. Note that the transporting processing portion 17 is not illustrated in FIG. 12.

More specifically, the manufacturing device 10 is constituted by a cutting and eliminating processing portion 18 having a function of cutting the insulated wire 100 and a function of stripping away the insulating covering 102; a marking processing portion 13*f*, a testing processing portion 14*f*, and a crimping processing portion 15*f* for one end side of the insulated wire 100; a marking processing portion 13*r*, a testing processing portion 14*r*, and a crimping processing portion 15*r* for the other end side of the insulated wire 100; and a defective products eliminating processing portion 16*r* that cuts defective crimp terminals 200.

Note that the marking processing portion 13*f*, the testing processing portion 14*f*, the crimping processing portion 15*f*, the marking processing portion 13*r*, the testing processing portion 14*r*, the crimping processing portion 15*r*, and the defective products eliminating processing portion 16*r* have the same configurations as those described in the aforementioned embodiment, and thus detailed descriptions thereof will be omitted.

This manufacturing device 10 strips away the insulating covering 102 from the insulated wire 100 transported in a transporting direction C11 using the cutting and eliminating processing portion 18, and then, in the same manner as the aforementioned embodiment, crimp-connects one end of the insulated wire 100 in the longitudinal direction X to the crimp terminal 200 using the marking processing portion 13*f*, the testing processing portion 14*f*, and the crimping processing portion 15*f* while transporting the insulated wire 100 in a transporting direction C12, a transporting direction C13, and a transporting direction C14 in that order.

Then, the manufacturing device 10 transports the insulated wire 100 whose one end has been crimp-connected to the crimp terminal 200 to the testing processing portion 14*f* by moving the insulated wire 100 in a transporting direction C15, and then, after testing the state of the crimping of the crimp terminal 200 using the testing processing portion 14*f*, transports the insulated wire 100 to the cutting and eliminating processing portion 18 by moving the insulated wire 100 in a transporting direction C16.

After the insulated wire 100 is transported to the cutting and eliminating processing portion 18, the manufacturing device 10 transports the insulated wire 100 by a predetermined length in the longitudinal direction X, and then cuts the other end side of the insulated wire 100, which is not yet crimped to a crimp terminal 200, using the cutting and eliminating processing portion 18.

Then, in the same manner as in the aforementioned embodiment, the manufacturing device 10 crimp-connects the crimp terminal 200 to the other end side of the insulated wire 100 using the marking processing portion 13*r*, the testing processing portion 14*r*, and the crimping processing portion 15*r* while transporting the insulated wire 100 in a transporting direction C18, a transporting direction C19, and a transporting direction C20 in that order. As a result, the connection structure 1 in which crimp terminals 200 are crimp-connected to both ends in the longitudinal direction X is formed.

Then, the manufacturing device 10 moves the connection structure 1 in a transporting direction C21, tests the state of the crimping of the crimp terminal 200 on the other end side using the testing processing portion 14*r*, moves the connection structure 1 in a transporting direction C22, and then transports the connection structure 1 to the defective products eliminating processing portion 16*r* or discharges the connection structure 1 from the manufacturing device 10 in accordance with a result of the testing.

The manufacturing device 10 that crimp-connects the crimp terminals 200 to both ends of the insulated wire 100 in this manner can achieve the same effects as in the aforementioned embodiment.

Figure 13:
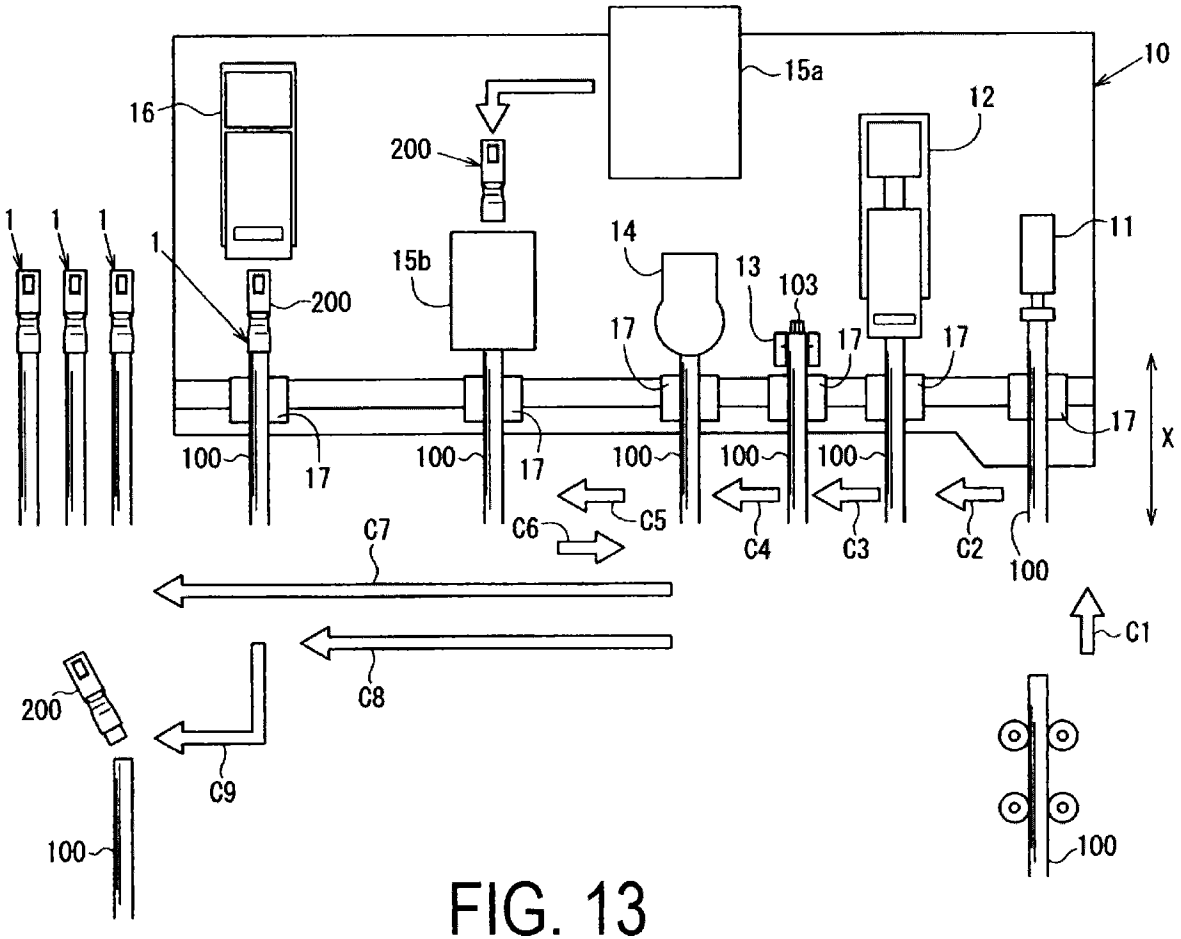
FIG. 13 is a plan view illustrating, from above, the external appearance of another device for manufacturing a connection structure.

In addition, for example, as illustrated in FIG. 13, which is a plan view illustrating another manufacturing device 10 for a connection structure 1, the manufacturing device 10 may carry out the carrier cutting step that separates the crimp terminal 200 from the terminal connecting belt 300 using an independent carrier cutting processing portion 15*a*.

To be more specific, the manufacturing device 10 includes the tip detection processing portion 11, the cover stripping processing portion 12, the marking processing portion 13, the testing processing portion 14, a crimping processing portion 15*b*, and the defective products eliminating processing portion 16, disposed in that order, and includes the carrier cutting processing portion 15*a* arranged opposite from the arrangement of the tip detection processing portion 11 to the crimping processing portion 15*b*. Furthermore, the manufacturing device 10 includes the transporting processing portion 17, in the same manner as in the aforementioned embodiment.

Note that the tip detection processing portion 11, the cover stripping processing portion 12, the marking processing portion 13, the testing processing portion 14, the defective products eliminating processing portion 16, and the transporting processing portion 17 have the same configurations as in the aforementioned embodiment, and thus detailed descriptions thereof will be omitted.

The carrier cutting processing portion 15*a* has a function of separating the crimp terminal 200 from a transported terminal connecting member 300.

The crimping processing portion 15*b* has a function of inserting the insulated wire 100 whose aluminum core wire 101 is exposed into the crimp terminal 200 transported from the carrier cutting processing portion 15*a* by predetermined transporting means, and a function of crimping the crimping portion 230 and the insulated wire 100 together.

This manufacturing device 10 can carry out a step for exposing the aluminum core wire 101 from the insulated wire 100 and putting the insulated wire 100 into a crimpable state and a step for separating the crimp terminal 200 from the terminal connecting member 300 in parallel. As such, the method of manufacturing the connection structure 1 and the manufacturing device 10 for the connection structure 1 can manufacture the connection structure 1 efficiently.

REFERENCE NUMBER

1 . . . Connection structure
2 . . . Wire harness
3 . . . Female connector housing
4 . . . Wire harness
5 . . . Male connector housing
10 . . . Manufacturing device
12 . . . Cover stripping processing portion
13, 13*f*, 13*r* . . . Marking processing portion
14, 14*f*, 14*r* . . . Testing processing portion
15*a* . . . Carrier cutting processing portion
15, 15*b*, 15*f*, 15*r* . . . Crimping processing portion
17 . . . Transporting processing portion
18 . . . Cutting and eliminating processing portion
40 . . . Separating blade
41 . . . Crimping blade
100 . . . Insulated wire
101 . . . Aluminum core wire
102 . . . Insulating covering

103 . . . Electric wire tip portion
104 . . . Mark
200 . . . Crimp terminal
230 . . . Crimping portion
250 . . . Carrier
300 . . . Terminal connecting belt
X . . . Longitudinal direction
Y . . . Width direction

The invention claimed is:

1. A method of manufacturing a connection structure, comprising:

separating a crimp terminal from a terminal connecting belt coupled to a carrier formed in a band shape;

inserting, after the separating, at least an electric wire tip portion of an insulated wire into a crimping portion of the crimp terminal separated from the terminal connecting belt; and crimping, after the inserting, the crimping portion of the crimp terminal into which the electric wire tip portion has been inserted such that a crimping blade holds and crimps the crimping portion and that a crimp connection is formed on the insulated wire, wherein the insulated wire comprises a conductor and an insulating covering that covers the conductor such that the insulated wire has the electric wire tip portion on a tip side of the insulated wire, the carrier has a band shape, the crimp terminal is one of a plurality of crimp terminals connected to the carrier through the terminal connecting belt such that the plurality of crimp terminals is connected to the carrier along a latitudinal direction of the carrier at predetermined intervals in a longitudinal direction of the carrier, each of the crimp terminals has a closed-barrel shape, and the separating of the crimp terminal comprises separating the crimp terminal from the terminal connecting belt by a separating blade while the crimping blade pinches the crimping portion of the crimp terminal, and wherein the method further comprises:

stripping, before the separating, the insulating covering from the tip side of the insulated wire such that the electric wire tip portion is formed;

applying, after the stripping and before the separating, a mark on the insulating covering at a predetermined position based on a length of the electric wire tip portion inserted into the crimping portion; and testing, after the stripping, the applying, the separating, the inserting, and the crimping, a state of the crimping of the electric wire tip portion to the crimping portion using the mark.

2. The method of manufacturing the connection structure according to claim 1, wherein the terminal connecting belt includes the crimp terminal having the crimping portion.

3. The method of manufacturing the connection structure according to claim 1, wherein the separating of the crimping terminal comprises holding the crimping portion of the crimp terminal by the crimping blade without re-clamping the crimping portion until the connection structure is discharged by crimping blade.

4. The method of manufacturing the connection structure according to claim 1, further comprising:

determining whether the connection structure is a defective product; and cutting the connection structure from the insulated wire if the connection structure is determined to be defective.

5. The method of manufacturing the connection structure according to claim 1, wherein the conductor comprises an aluminum-based material, and at least the crimping portion comprises a copper-based material.

6. A wire harness, comprising:

a connector housing; and a plurality of connection structures produced by separating a crimp terminal from a terminal connecting belt coupled to a carrier formed in a band shape, inserting, after the separating, at least an electric wire tip portion of an insulated wire into a crimping portion of the crimp terminal separated from the terminal connecting belt, and crimping, after the inserting, the crimping portion of the crimp terminal into which the electric wire tip portion has been inserted such that a crimping blade holds and crimps the crimping portion and that a crimp connection is formed on the insulated wire, wherein the insulated wire comprises a conductor and an insulating covering that covers the conductor such that the insulated wire has the electric wire tip portion on a tip side of the insulated wire, the carrier has a band shape, the crimp terminal is one of a plurality of crimp terminals connected to the carrier through the terminal connecting belt such that the plurality of crimp terminals is connected to the carrier along a latitudinal direction of the carrier at predetermined intervals in a longitudinal direction of the carrier, each of the crimp terminals has a closed-barrel shape, and the separating of the crimp terminal comprises separating the crimp terminal from the terminal connecting belt by a separating blade while the crimping blade pinches the crimping portion of the crimp terminal, the plurality of connection structures being bundled together such that the crimp terminals of the connection structures are mounted within the connector housing, and wherein the plurality of connection structures are further produced by stripping, before the separating, the insulating covering from the tip side of the insulated wire such that the electric wire tip portion is formed, applying, after the stripping and before the separating, a mark on the insulating covering at a predetermined position based on a length of the electric wire tip portion inserted into the crimping portion, and testing, after the stripping, the applying, the separating, the inserting, and the crimping, a state of the crimping of the electric wire tip portion to the crimping portion using the mark.

7. A device for manufacturing a connection structure, comprising:

a crimping blade configured to pinch and crimp a crimping portion of a crimp terminal into which an electric wire tip portion of an insulated wire has been inserted such that a crimp connection is formed on the insulated wire;

a separating blade configured to separate, after pinching and crimping, the crimp terminal from a terminal connecting belt coupled to a carrier formed in a band shape; and an electric wire insertion device that inserts, after separating, at least the electric wire tip portion of the insulated wire into a crimping portion of the crimp terminal separated from the terminal connecting belt, wherein the insulated wire comprises a conductor and an insulating covering that covers the conductor such that the insulated wire has the electric wire tip portion on a tip side of the insulated wire, the carrier has a band shape, the crimp terminal is one of a plurality of crimp terminals connected to the carrier through the terminal connecting belt such that the plurality of crimp terminals is connected to the carrier along a latitudinal direction of the carrier at predetermined intervals in a longitudinal direction of the carrier, and each of the crimp terminals has a closed-barrel shape, and wherein the device further comprises:

a cover stripping device that strips, before separating, the insulating covering from the tip side of the insulated wire such that the electric wire tip portion is formed;

a marking device that applies, after stripping and before separating, a mark on the insulating covering at a predetermined position based on a length of the electric wire tip portion inserted into the crimping portion; and a testing device that tests, after stripping, applying, separating, inserting, and pinching and crimping, a state of the crimping of the electric wire tip portion to the crimping portion using the mark.

8. The device for manufacturing the connection structure according to claim 7, wherein the terminal connecting belt includes the crimp terminal having the crimping portion.

9. The device for manufacturing the connection structure according to claim 7, further comprising:

a defective product eliminating device that cuts the connection structure that crimps and connects the insulated wire and the crimp terminal if the connection structure is determined to be defective.

10. The device for manufacturing the connection structure according to claim 7, wherein the marking device applies the mark to the insulated wire in which the electric wire tip portion has been formed by the cover stripping device, and the state of the crimping of the electric wire tip portion to the crimping portion is tested using the mark applied by the marking device.

11. The method of manufacturing the connection structure according to claim 1, wherein the inserting of the electric wire tip portion comprises inserting the electric wire tip portion of the insulated wire into the crimping portion of the crimp terminal while holding the crimping portion of the crimp terminal by the crimping blade.

12. The method of manufacturing the connection structure according to claim 3, wherein the inserting of the electric wire tip portion comprises inserting the electric wire tip portion of the insulated wire into the crimping portion of the crimp terminal while holding the crimping portion of the crimp terminal by the crimping blade.

13. The method of manufacturing the connection structure according to claim 2, wherein the inserting of the electric wire tip portion comprises inserting the electric wire tip portion of the insulated wire into the crimping portion of the crimp terminal while holding the crimping portion of the crimp terminal by the crimping blade.

14. The method of manufacturing the connection structure according to claim 4, wherein the inserting of the electric wire tip portion comprises inserting the electric wire tip portion of the insulated wire into the crimping portion of the crimp terminal while holding the crimping portion of the crimp terminal by the crimping blade.

15. The method of manufacturing the connection structure according to claim 5, wherein the inserting of the electric wire tip portion comprises inserting the electric wire tip portion of the insulated wire into the crimping portion of the crimp terminal while holding the crimping portion of the crimp terminal by the crimping blade.

16. The method of manufacturing the connection structure according to claim 1, wherein, in a plan view, a rearward lower end of the crimping portion of the crimp terminal is coupled with the carrier such that the crimp terminal is orthogonal with respect to the carrier.

* * * * *